US011267672B1

(12) United States Patent
Couchey et al.

(10) Patent No.: US 11,267,672 B1
(45) Date of Patent: Mar. 8, 2022

(54) YARN CARRIER TUBES

(71) Applicant: Sonoco Development Inc., Hartsville, SC (US)

(72) Inventors: Brian P. Couchey, Inman, SC (US); Edmond Fratianni, Old Chatham, NY (US)

(73) Assignee: SONOCO DEVELOPMENT, Inc., Hartsville, SC (US)

( * ) Notice: Subject to any disclaimer, the term of this patent is extended or adjusted under 35 U.S.C. 154(b) by 0 days.

(21) Appl. No.: 17/010,189

(22) Filed: Sep. 2, 2020

(51) Int. Cl.
*B65H 75/28* (2006.01)
*B65H 65/00* (2006.01)

(52) U.S. Cl.
CPC ..... *B65H 75/28* (2013.01); *B65H 65/00* (2013.01); *B65H 2701/31* (2013.01)

(58) Field of Classification Search
CPC combination set(s) only.
See application file for complete search history.

(56) References Cited

U.S. PATENT DOCUMENTS

| | | | |
|---|---|---|---|
| 3,625,451 | A | 12/1971 | Anderson |
| 6,412,728 | B1 | 7/2002 | Jen |
| 7,114,227 | B2 | 10/2006 | Lin |
| 7,240,875 | B2 | 7/2007 | Hernandez et al. |
| 7,770,272 | B2 | 8/2010 | Lin |
| 9,260,272 | B2 | 2/2016 | Lin |
| 2004/0238684 | A1 | 12/2004 | Romagnoli |
| 2005/0017121 | A1 | 1/2005 | Norman |
| 2009/0173814 | A1 | 7/2009 | Hernandez et al. |

FOREIGN PATENT DOCUMENTS

| | | | |
|---|---|---|---|
| DE | 3923305 | A1 | 2/1990 |
| DE | 29618541 | U1 | 1/1997 |
| JP | S6260783 | A | 3/1987 |
| JP | 2003012236 | A | 1/2003 |

OTHER PUBLICATIONS

Mariplast, Poy tubes technical sheet; downloaded from https://uploads.strikinglycdn.com/files/059367e7-8c49-463c-882b-b7b2762e14d5/POY%20Tubes%20website%20english%20PDF.pdf on Sep. 2, 2020; 1 page.

International Search Report and Written Opinion issued in International application No. PCT/US2021/044130 dated Oct. 19, 2021; 15 pages [Only new art cited herein; counterpart U.S. Pat. No. 6412728B1 of D1-EP1186564 and The issue U.S. Pat. No. 7770272B2 of D4-US2010058811 were cite in the IDS filed by the applicant on Sep. 2, 2020].

*Primary Examiner* — William E Dondero
(74) *Attorney, Agent, or Firm* — Nelson Mullins Riley & Scarborough LLP

(57) ABSTRACT

The present disclosure is directed to a reusable yarn carrier tube around which yarn may be wound at high speeds (e.g., within winding machines). The yarn carrier tube may include a pick-up groove having structural features configured to better snag yarn to initiate winding of the yarn around the cylindrical body of the yarn carrier tube. The structural features may include an adaptable snagging feature that is adaptable to many different yarn types (e.g., diameter, denier, texture, material). The structural features may include projections (e.g., teeth) with incremental narrowing therebetween in the direction opposite to the rotational winding direction. The teeth may increase in sharpness (e.g., decreasing radii of curvature) as the yarn moves further into the pick-up groove.

42 Claims, 13 Drawing Sheets

YARN CARRIER TUBES

FIELD OF THE DISCLOSURE

The present disclosure relates to systems and methods for snagging yarn at high speeds with reusable yarn carrier tubes adaptable to yarns of varying thicknesses.

BACKGROUND OF THE DISCLOSURE

The present disclosure relates generally to the winding of thread, filament, and/or yarn after extrusion, twisting, dyeing, texturizing, and/or another processing operation using winding machines that seamlessly create yarn packages, one after the other, without pausing in between. This method of continuous winding may advantageously maintain uniform tensions in yarns and minimize any waste of material and/or time.

In the production of yarn, it is customary practice to wind the finished yarn onto yarn carrier tubes, spools, bobbins, and/or other types of textile yarn carriers to form a yarn package suitable for storage, shipment, and/or subsequent use (e.g., in a tufting machine). For example, in the extrusion of carpet yarns, a hollow cylindrical shell bobbin or yarn carrier tube with a circumferential outer support surface for winding the yarn may be used. The winding of the yarn onto a yarn carrier tube to form the yarn package is usually started by rotating the yarn carrier tube at a relatively high speed. While rotating, the yarn carrier tube may frictionally engage the yarn so as to cause incipient winding of the yarn onto the yarn carrier tube.

Conventional yarn carrier tubes have been paper-based so that manufacturers can manually create slits/grooves to grab and hold yarn at the start-up of winding by cutting into the tubes with a knife, for example. The natural roughness of the cut paper creates tension to snag the yarn. However, paper-based yarn carrier tubes have limits on how many times they can be used (e.g., only once) before damage to the tube and/or slits/grooves inhibits the ability of an empty yarn carrier tube to pick up yarn within the winding machine.

This limitation on the reusability of the paper-based yarn carrier tubes may be costly. Many carpet manufacturers, for example, exclusively wind extruded yarn onto one-time use paper cones. Additionally, between the different processing steps (e.g., extruding, twisting, dyeing, weaving, tufting) yarns may have to be wound onto yarn carrier tubes in order to be transported between machines. Thus, a certain length of yarn may be wound, unwound, and rewound on several different yarn carrier tubes before reaching the final step of its processing as yarn.

Previous solutions to the reusability issue with paper-based yarn carrier tubes have included creating reusable yarn catch inserts that can be added and removed from paper-based yarn carrier tubes. A recess for the yarn catch insert was formed in the circumferential supporting surface and extended at least partially around the yarn carrier tube. The yarn catch insert was then mounted within the recess that could then catch the yarn to facilitate the initiation of winding of the yarn around the yarn carrier tube to form a yarn package. The yarn catch inserts have included various structural features (e.g., fingers, yarn pinch areas, transition zones) customized to more reliably engage and grasp a particular type of yarn as it is moved across the supporting surface of the yarn carrier tube. These prior yarn catch inserts were made separate from the paper-based yarn carrier tubes in order to preserve the structural features configured to catch the yarn to initiate winding around the yarn carrier tube. Due to the high rotational speeds, the inserts required barbs or other locking means to ensure the centrifugal forces would not throw the insert from the yarn carrier tube. However, it takes time to remove and replace these inserts from the paper-based yarn carrier tubes, and the recesses eventually wear out such that the inserts can no longer be secured in the supporting surface of the paper-based yarn carrier tube.

Other solutions involve the use of plastic yarn carrier tubes, which have improved durability and reusability. One drawback to plastic yarn carrier tubes, however, is that plastic is much slicker than paper and it may be difficult to replicate, using injection molding, three-dimensional printing, or other methods for polymeric construction, the rough-edged knife slit that is cut into paper-based yarn carrier tubes. Additionally, existing yarn carrier tubes may provide inconsistent frictional contact between the yarn and the yarn carrier tube, which provides erratic results in starting the winding of the yarn onto the yarn carrier tube.

Through ingenuity and hard work, the inventors have developed improved means for frictionally engaging and holding (e.g., snagging) yarn brought into contact therewith to facilitate the initiation of the winding of the yarn onto the yarn carrier tube to form the yarn package. Moreover, the invention is effective with a broad range of different yarn types (e.g., yarns of different thicknesses, diameters, materials, weights, and/or deniers).

BRIEF SUMMARY OF THE DISCLOSURE

The present disclosure relates to fiber or yarn carrier tubes (plastic, in some embodiments) with a groove (e.g., pick-up, snag feature) for snagging the yarn to wind it onto the yarn carrier tube at very high speeds. As the yarn moves toward an end of the yarn carrier tube against the rotating circumferential surface of the yarn carrier tube, the yarn will eventually fall into the pick-up groove formed in the yarn carrier tube and be snagged by the fang, causing the yarn to break-off and begin winding around the yarn carrier tube. Specifically, the present disclosure relates to the structural features of the groove. The pick-up groove may include incremental narrowing between the projections (e.g., teeth) that provide the grabbing action of the pick-up groove. This incremental narrowing may ensure that yarn of any thickness and/or material may be snagged by the pick-up groove. In this way, the yarn carrier tube of the present disclosure may be reusable with yarns of various thicknesses. In some embodiments, the yarn carrier tube on the invention may have at least twice the usable life as compared with standard carrier tubes.

In an embodiment, the invention comprises a reusable yarn carrier tube for winding yarns of various thicknesses thereon at high speeds as the carrier tube is rotated in a rotational winding direction. The carrier tube may comprise a circumferential wall and a pick-up groove formed through and extending along the azimuthal direction of the circumferential wall, circumscribed by a sidewall. The pick-up groove may comprise a plurality of teeth projecting from the sidewall of the pick-up groove toward a central azimuthal axis of the pick-up groove, wherein the distance between the teeth, as measured across the pick-up groove in the longitudinal direction of the circumferential wall, decreases in a direction opposite to the rotational winding direction.

In an embodiment, each tooth in the plurality of teeth includes a leading edge facing the rotational winding direction, each leading edge having a degree of sharpness, and the plurality of teeth comprises a first tooth with a first degree of sharpness, and a second tooth with a second degree of sharpness, wherein the first degree of sharpness is less than the second degree of sharpness. The first tooth may have a radially outward-facing surface angled toward a longitudinal central axis of the carrier tube at a first angle. The second tooth may have a radially outward-facing surface angled toward the longitudinal central axis of the carrier tube at a second angle, and the first angle may be greater than the second angle. Radially outward-facing surfaces of a majority of the plurality of teeth may be angled toward the longitudinal central axis of the carrier tube at a second angle, and the first angle may be greater than the second angle. The second tooth may have a radially outward-facing surface angled toward the longitudinal central axis of the carrier tube at a third angle, and the third angle may be greater than the second angle. The second angle may be about 10° and the first angle may be about 25°.

In an embodiment, each tooth of the plurality of teeth includes a leading edge generally facing the rotational winding direction, each leading edge having a degree of sharpness, and the degree of sharpness of the leading edge of the teeth increases in a direction opposite to the rotational winding direction. The plurality of teeth may comprise a first tooth having a lowest degree of sharpness such that the leading edge of the first tooth forms a smooth guiding surface for leading the yarn further into the pick-up groove in the direction opposite to the rotational winding direction. In an embodiment, the degree of sharpness of the leading edge is based on a radius of curvature of the leading edge. In an embodiment, the plurality of teeth comprises: a first set of teeth projecting from a first sidewall of the pick-up groove toward the central azimuthal axis of the pick-up groove, and a second set of teeth projecting from a second sidewall of the pick-up groove toward the first set of teeth and the central azimuthal axis of the pick-up groove; and each tooth within the first set of teeth is offset from each tooth within the second set of teeth. In an embodiment, each tooth within the plurality of teeth has a tip, distal from the sidewall of the pick-up groove from which the tooth projects; and the tip of at least one tooth of the plurality of teeth extends past the central azimuthal axis.

In an embodiment, the yarn carrier tube further comprises: a fang for initially snagging the yarn into the pick-up groove, wherein the fang includes a tip pointing in the rotational winding direction. The pick-up groove may include a plurality of zones, in which the width of the pick-up groove in each zone decreases in a direction opposite to the rotational winding direction. The plurality of zones may include at least one of a gathering zone, a transition zone, and a snagging zone. The plurality of zones may include a third zone, in which an adaptable snagging feature is located.

In an embodiment, each tooth within the plurality of teeth has a tip, distal from the sidewall of the pick-up groove from which the tooth projects; and the distance between the sidewall from which each tooth projects to the tip of each tooth is substantially the same. In an embodiment, each tooth within the plurality of teeth has a tip, distal from the sidewall of the pick-up groove from which the tooth projects; and the distance between the sidewall from which each tooth projects to the tip of each tooth increases in the direction opposite to the rotational winding.

In an embodiment, the invention comprises a reusable yarn carrier tube for winding yarns thereon as the carrier tube is rotated in a rotational winding direction at high speeds, the carrier tube comprising: a circumferential wall formed cylindrically with an exterior surface, an interior surface, and two ends; and a pick-up groove: adjacent to an adjacent end of the two ends, and distal from a distal end of the two ends, formed through and extending along the azimuthal direction of the circumferential wall, circumscribed by sidewalls including an adjacent-end-facing sidewall and a distal-end-facing sidewall, and comprising a plurality of teeth projecting from the sidewalls of the pick-up groove toward a central azimuthal axis of the pick-up groove, wherein each tooth of the plurality of teeth comprises: a radially outward-facing surface, a leading edge configured to first encounter yarn moving further into the pick-up groove as the carrier tube is rotated in the rotational winding direction, a trailing edge positioned opposite the leading edge, and a tip, where the leading edge and the trailing edge meet, distal from the sidewall from which the tooth projects, wherein the degree of sharpness of the teeth increases in a direction opposite to the rotational winding direction.

In an embodiment, the degree of sharpness of each tooth is based on a radius of curvature of the leading edge of the tooth. In an embodiment, the plurality of teeth comprises: a first tooth wherein the leading edge forms an obtuse angle with the sidewall from which the first tooth projects. In an embodiment, the plurality of teeth comprises: a first tooth wherein the radially outward-facing surface is angled toward a longitudinal central axis of the carrier tube at a first angle. The plurality of teeth may further comprise: a second tooth wherein the radially outward-facing surface is angled toward the longitudinal central axis of the carrier tube at a second angle, wherein the first angle is greater than the second angle.

In an embodiment, the radially outward-facing surfaces of a majority of the plurality of teeth are angled toward the longitudinal central axis of the carrier tube at a second angle, and the first angle is greater than the second angle. In an embodiment, the plurality of teeth further comprises: a second tooth wherein the radially outward-facing surface is angled toward the longitudinal central axis of the carrier tube at a third angle, wherein third angle is greater than the second angle.

In an embodiment, the plurality of teeth comprises: a first set of teeth projecting from the adjacent-end-facing sidewall of the pick-up groove toward the central azimuthal axis of the pick-up groove, and a second set of teeth projecting from the distal-end-facing sidewall of the pick-up groove toward the first set of teeth and the central azimuthal axis of the pick-up groove; and each tooth within the first set of teeth is offset from each tooth within the second set of teeth. In an embodiment, the tip of at least one tooth of the plurality of teeth extends past the central azimuthal axis of the pick-up groove.

The yarn carrier tube may further comprise: a fang for initially snagging the yarn into the pick-up groove, wherein the fang includes a tip pointing in the rotational winding direction. The pick-up groove may incrementally narrow in the direction opposite to the rotational winding direction. The distance between the sidewall from which each tooth projects to the tip of each tooth may be substantially the same or may increase in a direction opposite to the rotational winding. In an embodiment, the pick-up groove includes a plurality of zones, in which the width of the pick-up groove in each zone decreases in a direction opposite to the rotational winding direction. In an embodiment, the plurality of teeth are located within the snagging zone. In an embodiment, the plurality of zones includes a third zone, in which the adaptable snagging feature is located.

BRIEF DESCRIPTION OF THE SEVERAL VIEWS OF THE DRAWING(S)

Having thus described the present disclosure in general terms, reference will now be made to the accompanying drawings, which are not necessarily drawn to scale, and wherein:

DETAILED DESCRIPTION OF THE DISCLOSURE

Figure 1A:
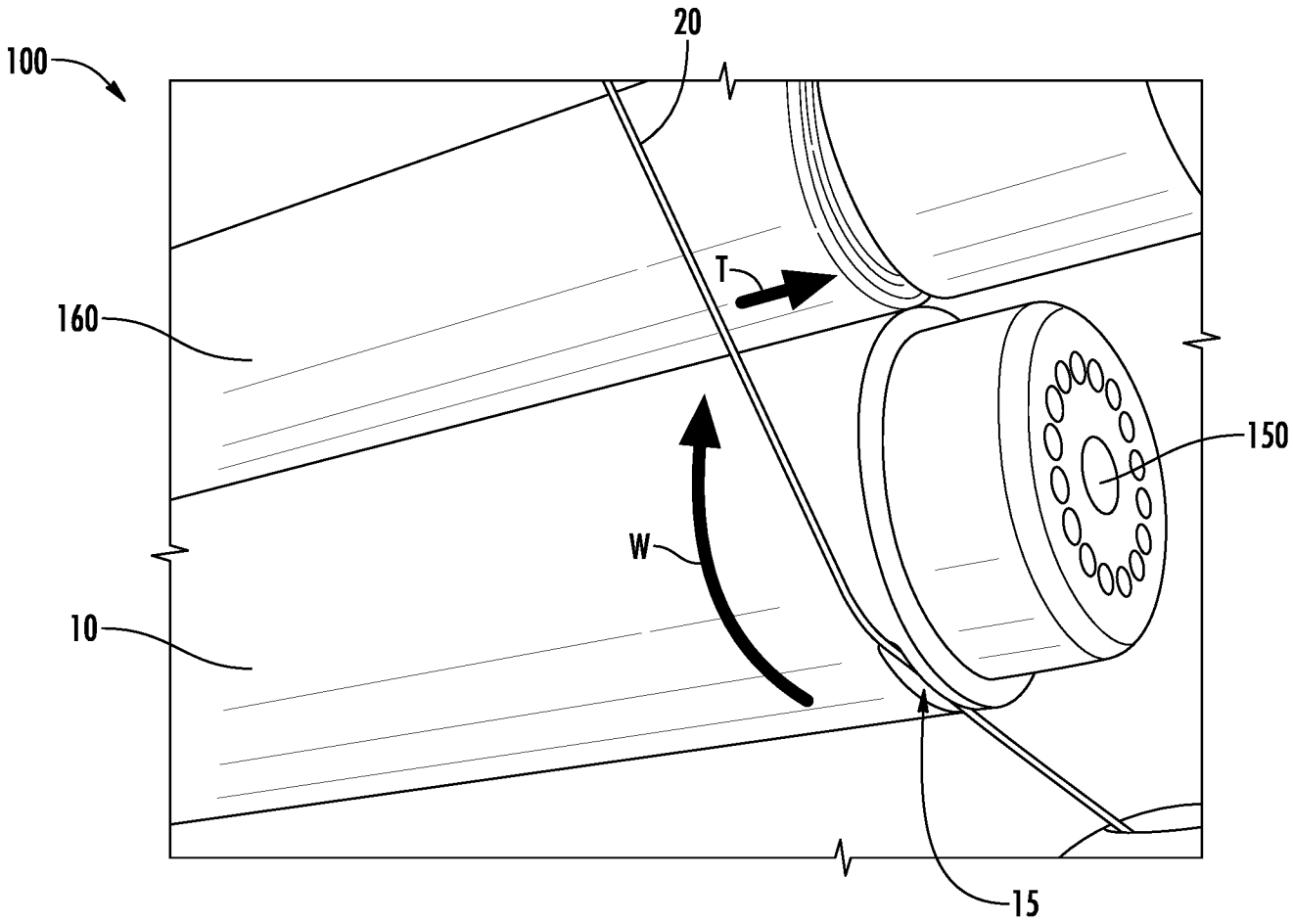
FIGS. 1A-1C are views of an empty yarn carrier tube within a winding machine environment at initiation of winding of yarn around the yarn carrier tube, in accordance with some embodiments of the present disclosure.

While this present disclosure may be embodied in many forms, there is shown in the drawings and will herein be described in detail one or more embodiments, with the understanding that this disclosure is to be considered an exemplification of the principles of the present disclosure and is not intended to limit the disclosure to the illustrated embodiments.

High-Speed Yarn Winding Machines

In the manufacture of threads or yarns (e.g., at a melt spinning plant), the yarns are wound onto yarn carrier tubes to form yarn packages. A yarn package may be defined as a predetermined length and/or weight of yarn wound compactly around a yarn carrier tube in order to store, transport, and/or unwind the yarn in an orderly fashion (e.g., in a dyeing or tufting machine). For example, carpet yarns may be wound into yarn packages with a predetermined maximum diameter (e.g., maximum of about 400 mm). The yarn packages may become feed packages in downstream processes, such as heat setting, weaving, and/or tufting. The attachments in feed creels for the downstream processes may be designed for the predetermined maximum diameter.

A winding machine may include multiple winders for producing multiple yarn packages simultaneously in parallel. At one winder, the winding machine may be fed a single strand (e.g., twisted multi-ply, one ply) of yarn for wrapping around a yarn carrier tube to form a yarn package. The winding machine may rotate the yarn carrier tube while guiding the single strand longitudinally back and forth along the yarn carrier tube (e.g., using a traversing module) to form overlapping layers of yarn wound onto the yarn carrier tube. The diameter of the overlapping layers of wound yarn wrapped around the yarn carrier tube may continuously increase due to the addition of yarn while winding. When the overlapping layers of wound yarn reach a certain thickness and/or diameter, the yarn carrier tube may be full, thus forming the yarn package.

In some embodiments, the winding machine may automatically switch the single strand of yarn over to a new empty yarn carrier tube after the previous yarn carrier tube is full. By automatically switching the single strand of yarn over to a new empty yarn carrier tube without stopping, the winding machine may maintain a substantially constant tension on the single strand of yarn. Keeping constant tensions of yarns throughout the winding machine may optimize operation of the machine through minimizing tangling or jamming issues that may otherwise arise by changing tension in fibers, as well as through producing uniform yarn packages. In this way, time and maintenance costs may be reduced by minimizing downtime of the winding machine.

At one winder within a winding machine, a yarn carrier tube may be mounted upon a mandrel, spindle, tube holder, and/or other means for rotation (e.g., spindle 150 in FIG. 1A) about the longitudinal central axis thereof. In some embodiments, the yarn carrier tubes may be standardized and have an inner diameter of about 73 mm and a length of about 290 mm. Accordingly, the spindles of the winding machine may have a corresponding diameter of less than about 73 mm in order to snugly fit into the inner diameter of the yarn carrier tube. These measurements are not limiting, however. The yarn carrier tube may be mounted securely on the spindle such that there is minimal or no relative movement between the spindle and the yarn carrier tube.

A winding machine 100 may drive the yarn carrier tube 10 to rotate, thereby winding the yarn onto the yarn carrier tube 10. A motor may rotate the spindle 150 to drive the rotation of the yarn carrier tube 10 directly or indirectly. In some embodiments, the winding machine may rotate the yarn carrier tube at rotational speeds to meet yarn winding rates of about 40-65 m/s, for example. In operation, the yarn carrier tube 10 may be rotated about its longitudinal central axis in a rotational winding direction, as indicated by the rotation arrow "W" in FIG. 1A. The single strand 20 of yarn may be positioned tangentially with respect to the circumferential wall 60 of the yarn carrier tube 10.

As the yarn carrier tube 10 is rotated, the single strand 20 of yarn to be wound is guided longitudinally (e.g., in the direction of the traverse arrow "T" as shown in FIG. 1A) in tension against and across the exterior rotating circumferential surface of yarn carrier tube 10. The yarn may then be frictionally engaged to initiate the winding of the yarn to form a yarn package. However, in many instances, the frictional contact between a conventional yarn carrier tube and the yarn is not sufficient to cause incipient winding. Thus, a pick-up groove 15 with specific structural features for engaging the yarn may be formed in the circumferential wall 60 of the yarn carrier tube 10.

Figure 1B:
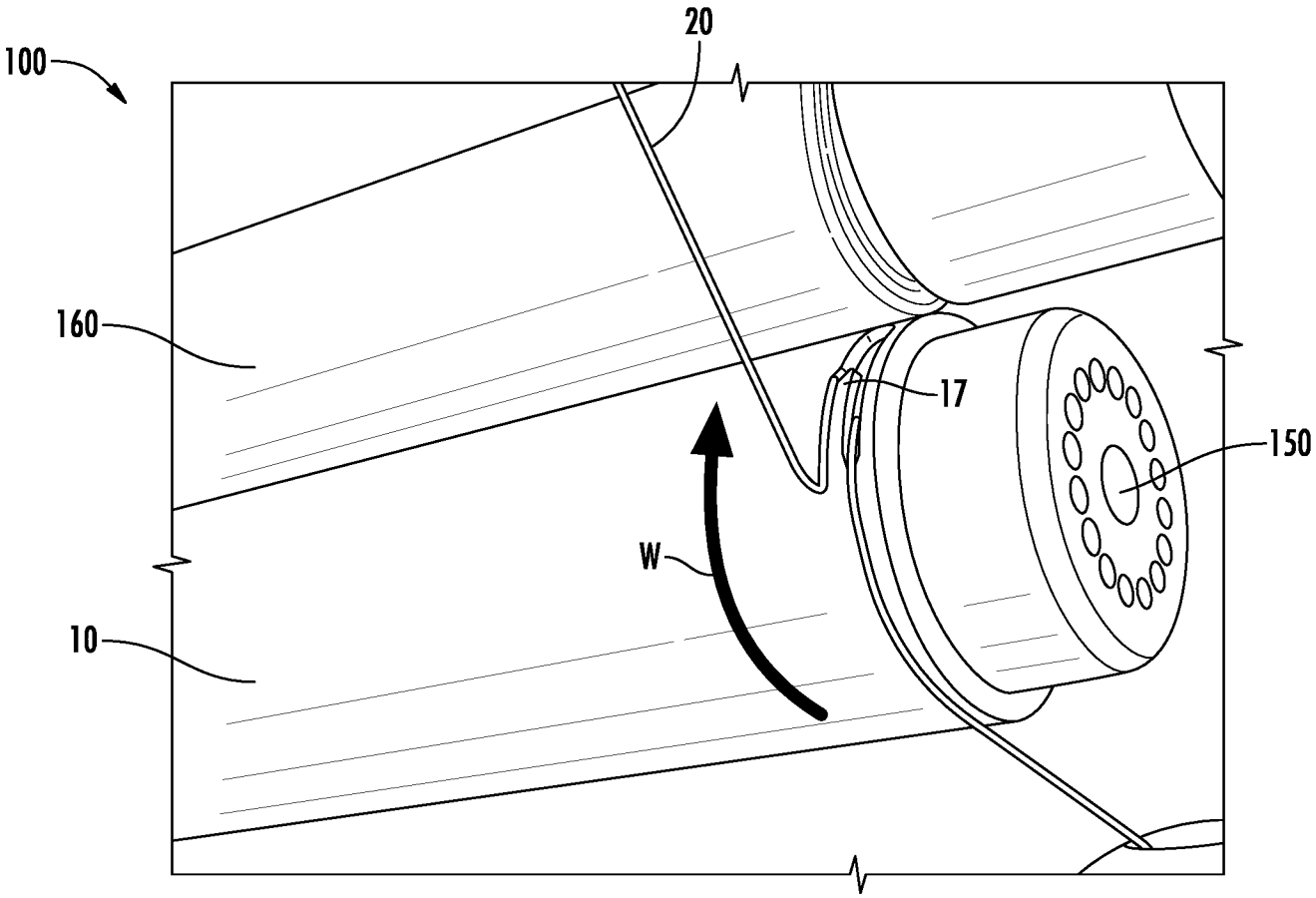

In some embodiments, during the rotation of the yarn carrier tube 10, the single strand 20 of yarn eventually falls into a pick-up groove 15 formed in or through the surface of the yarn carrier tube 10 (e.g., as shown in FIG. 1A). In some embodiments, the pick-up groove 15 may include a fang 17 that hooks the single strand 20 of yarn and causes the yarn to be pulled into the pick-up groove 15 (e.g., as shown in FIG. 1B). Once within the pick-up groove 15, the yarn may be frictionally engaged by the structural features of the pick-up groove 15 to cause incipient winding of the yarn onto the yarn carrier tube 10 to form a yarn package.

Figure 3:
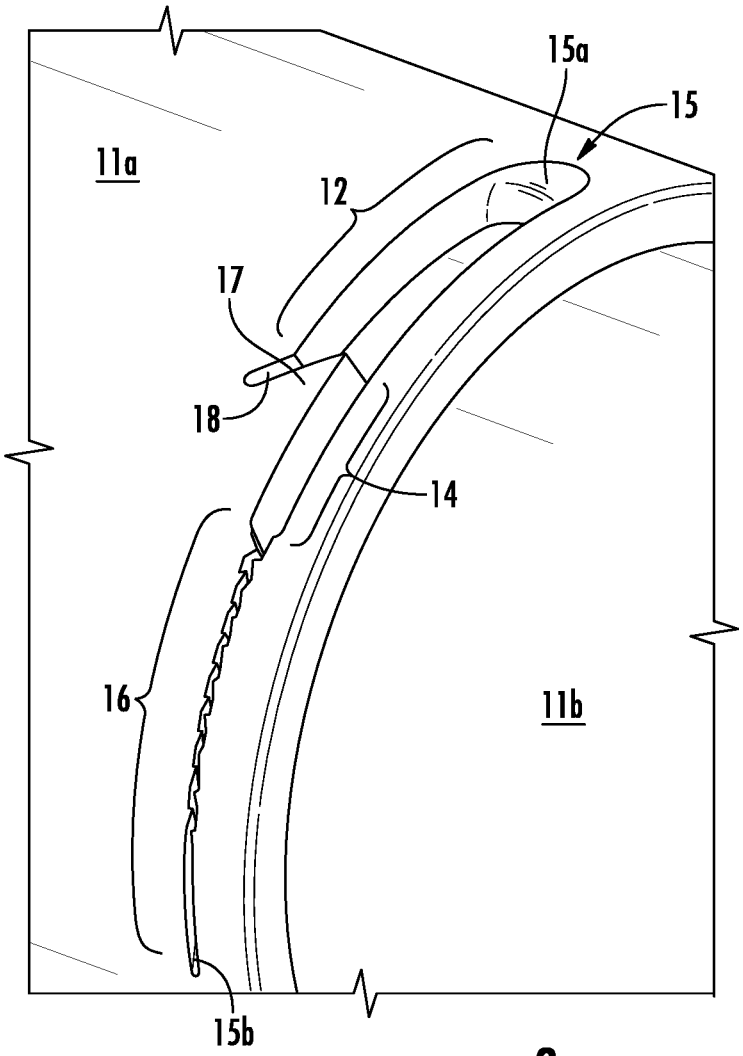
FIG. 3 is a magnified view of the structural features of the pick-up groove formed in the yarn carrier tube of FIG. 2, in accordance with some embodiments of the present disclosure.

In some embodiments, the yarn may first drop into a gathering zone 12 of the pick-up groove 15, slide along a transition zone 14 and into a snagging zone 16, and then may be engaged by the structural features of the snagging zone 16 (e.g., as shown in FIG. 3). The structural features may snag the yarn and initiate the winding of the yarn around the yarn carrier tube 10.

In some winding machines, automatic switching of the full yarn carrier tube to the empty yarn carrier tube may be provided by ejecting the full yarn carrier tube off the spindle and loading an empty yarn carrier tube onto the spindle. The empty yarn carrier tube may be provided from a loaded stack or reservoir of empty yarn carrier tubes that is stocked by operators, for example.

Alternatively or additionally, in some winding machines, there may be multiple spindles per winder, such that empty yarn carrier tubes may be loaded on spindles not in the winding position. The next spindle loaded with the empty yarn carrier tube may then be moved into the winding position, and the full yarn carrier tube may be removed from the previous spindle and replaced with an empty yarn carrier tube (e.g., by an operator). Other methods of switching the single strand of yarn from a full yarn carrier tube to an empty yarn carrier tube are possible.

Figure 1C:
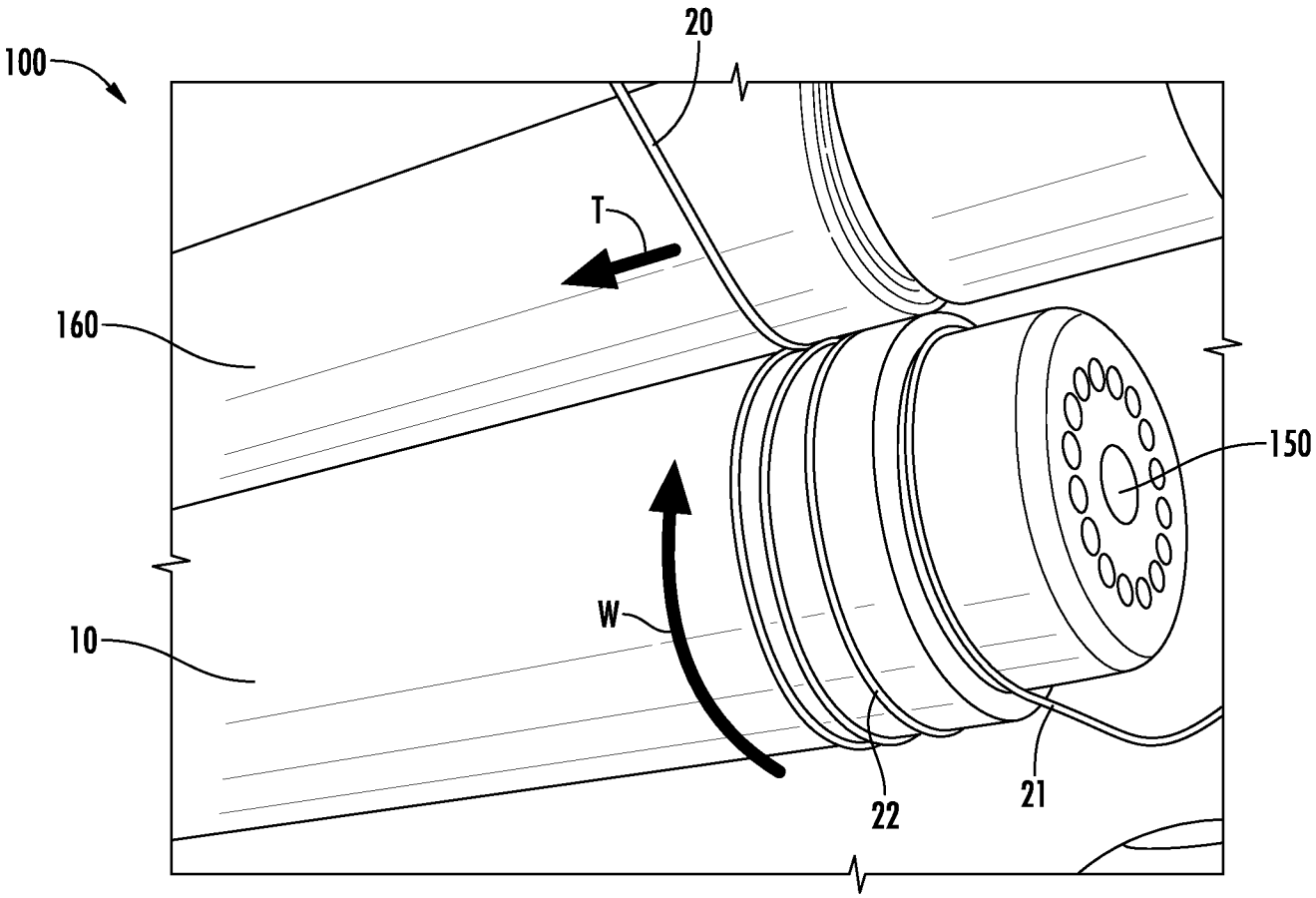

After the new empty yarn carrier tube is moved into place at the winder, the winding machine may guide the single strand of yarn over to one end of the yarn carrier tube, where the yarn catches and begins winding around the new yarn carrier tube. In order to separate the previous full yarn carrier tube from the new yarn carrier tube, the single strand 20 of yarn may break off to form an end tail 21 (e.g., as shown in FIG. 1C) during initial winding on the new yarn carrier tube due to tension formed in the yarn between the previous full yarn carrier tube and the new yarn carrier tube. During the winding, the single strand 20 of yarn may be moved back and forth (e.g., in a traversing direction, as shown by traverse arrow "T" in FIG. 1C) parallel to a longitudinal central axis of the yarn carrier tube 10.

In some winding machines (e.g., those that directly drive rotation of the yarn carrier tube), a separate traversing module may move the yarn back and forth along the length of the yarn carrier tube. The motion of the traversing module may form the structures and shapes of overlapping layers of yarn windings. The yarn carrier tubes may be wound with a standard traversing stroke (e.g., about 10 in.). The traversing stroke designates the extent of the traversing motion (e.g., oscillating motion between two extreme positions of the traversing module).

In some winding machines (e.g., those that indirectly drive rotation of the yarn carrier tube), the yarn carrier tube 10 may be frictionally driven to rotate via a pressure roller 160 (e.g., grooved drum) arranged parallel to the yarn carrier tube 10 when loaded on the spindle 150. In some embodiments, the grooved drum may include a yarn guide comprising slots formed therein in which the yarn is guided as the grooved drum rotates to move the yarn back and forth along the length of the yarn carrier tube, parallel to its longitudinal central axis. The pressure roller 160 may extend across the entire length of the spindle 150 to deposit various types of yarns on the yarn carrier tubes. The pressure roller 160 may contact the exterior surface 11*a* of the yarn carrier tube 10 and/or wound layers 22 of yarn with a predetermined contact pressure (e.g., via the weight of the pressure roller or via additional force transmitters). This predetermined contact pressure may be kept substantially constant during winding to aid in obtaining a uniform deposit of yarn on the yarn carrier tube. The pressure roller 160 may be arranged above or below the spindle 150 loaded with the yarn carrier tube 10. When the pressure roller 160 is arranged above the spindle 150 (e.g., as shown in FIG. 1C), the predetermined contact pressure of the pressure roller 160 may be unaffected by the increasing weight of the spindle 150 loaded with the yarn carrier tube 10 and wound yarn 22.

In some winding machines, the yarn carrier tube may be held at each end by two oppositely situated spindles or tube holders. In such embodiments, the yarn carrier tube may be supported by a backing roller. The yarn may be held between the backing roller and the yarn carrier tube and/or overlapping layers of wound yarn and deposited on the yarn carrier tube. The spindles of the winding machine may be rotatably fastened to a retaining arm that is attached to a shared swivel arm. As the diameter of the overlapping layers of yarn wound around the yarn carrier tube increases, the distance between the backing roller and the longitudinal central axis of the yarn carrier tube may increase. Accordingly, the increasing distance may be compensated for by movement of the retaining arms about a swivel axis of the swivel arm. After the winding operation is completed, the two spindles or tube holders may be moved apart in the direction of the longitudinal central axis of the yarn carrier tube, so that the full yarn carrier tube may be removed and an empty yarn carrier tube may be inserted. Movement of one or both of the full and empty yarn carrier tubes is possible, wherein the movement may take place linearly or also in the form of a swivel motion. In some embodiments, the backing roller with opposite bearing ends may be mounted on a movable roller carrier, configured to move through a support region (e.g., in contact with the yarn package) and/or a rest area (e.g., not in contact with yarn package).

Yarn Carrier Tubes

Figure 2:
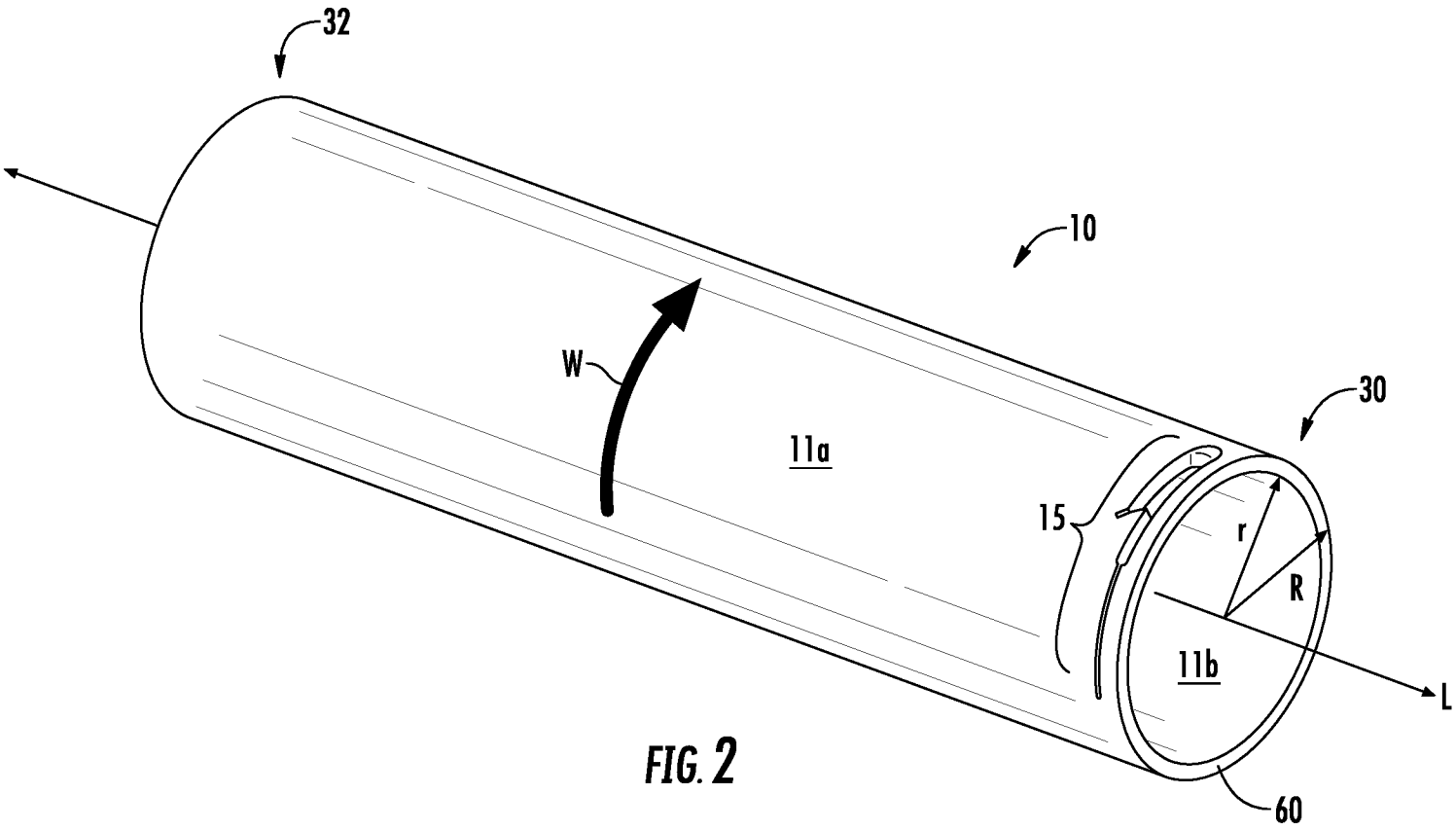
FIG. 2 is a top-front-right isometric view of a yarn carrier tube in isolation, in accordance with some embodiments of the present disclosure.

FIG. 2 illustrates a reusable yarn carrier tube 10 comprising a circumferential wall 60 and two ends 30, 32. The yarn carrier tube 10 may be generally shaped as a hollow right circular cylinder or cylindrical shell with an interior and exterior radius (e.g., as indicated by "r" and "R", respectively, in FIG. 2) and an axial length between the two ends 30, 32. The interior radius "r" may extend from a longitudinal central axis, indicated by the axis "L" in FIG. 2, of the yarn carrier tube 10 to an interior surface 11*b* inside the yarn carrier tube 10. The exterior radius "R" is larger than the interior radius "r" and extends from the longitudinal central axis "L" to an exterior surface 11*a* of the yarn carrier tube 10. The exterior and interior surfaces 11*a*, 11*b* and the material between them may constitute the circumferential wall 60 of the yarn carrier tube 10.

Pick-Up Groove

In some embodiments, the pick-up groove 15 may be positioned near or adjacent one end of the yarn carrier tube 10. In such embodiments, the pick-up groove 15 may be located proximal the end of the yarn carrier tube 10 or may be spaced inwardly from the end (e.g., end 30, 32) of the yarn carrier tube 10.

The yarn-receiving pick-up groove 15 may be formed through a portion of circumferential wall 60 of the yarn carrier tube 10. The pick-up groove 15 may be generally shaped as a slit that extends circumferentially around at least a portion of the yarn carrier tube 10, parallel to the rotational winding direction "W". The pick-up groove 15 may extend radially through the circumferential wall 60 of the yarn carrier tube 10, in some embodiments. In other embodiments, the pick-up groove 15 may extend partially or substantially but not fully through the wall 60.

Figure 4:
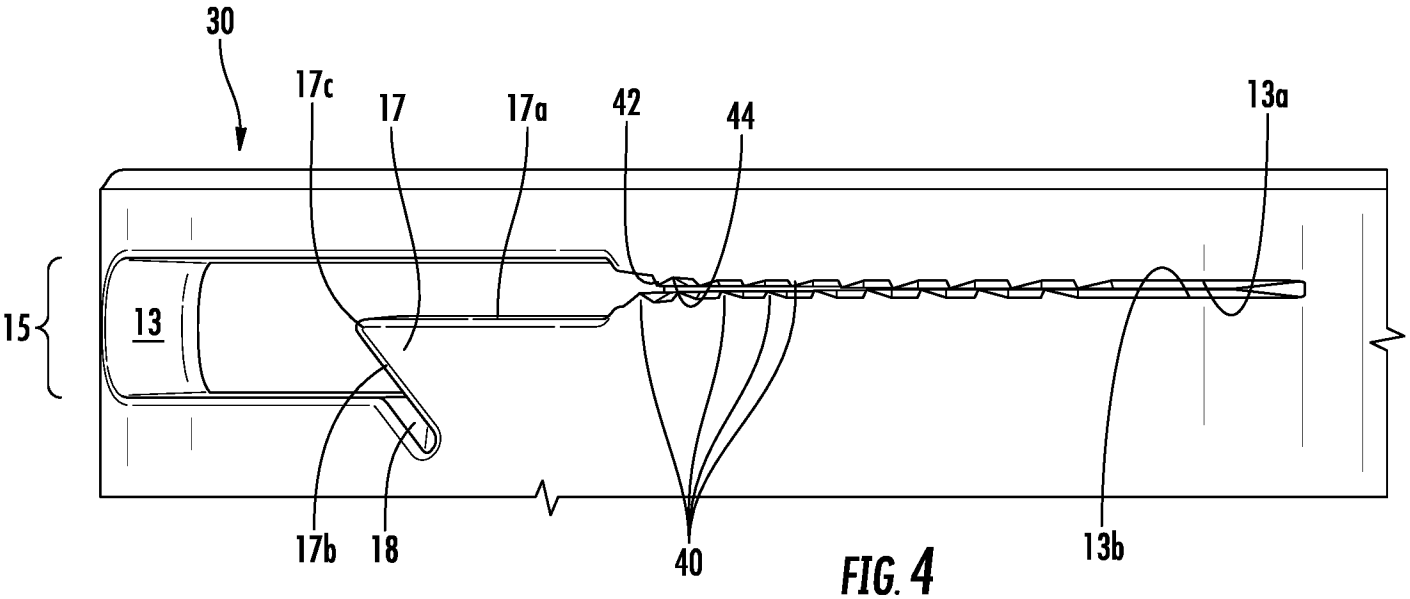
FIG. 4 is an elevational side view of a longitudinal cross-section of the yarn carrier tube of FIGS. 2-3, in accordance with some embodiments of the present disclosure.

A sidewall 13 (e.g., as shown in FIG. 4) of the circumferential wall 60, connecting the exterior and interior surfaces 11*a*, 11*b* of the yarn carrier tube 10, may circumscribe the pick-up groove 15. Within the groove 15, sidewall 13 may comprise at least a distal-end-facing sidewall 13*a*, generally facing the end of the yarn carrier tube 10 distal from the pick-up groove 15 (e.g., end 32 in FIG. 2), and an adjacent-end-facing sidewall 13*b*, generally facing the end of the yarn carrier tube 10 adjacent to the pick-up groove 15 (e.g., end 30 in FIG. 2). At least one of the distal-end-facing sidewall 13*a* and/or the adjacent-end-facing sidewall 13*b* may extend along the full length of the pick-up groove 15. The adjacent-end-facing sidewall 13*b* may be substantially parallel to the distal-end-facing sidewall 13*a*, in some embodiments.

Figure 6:
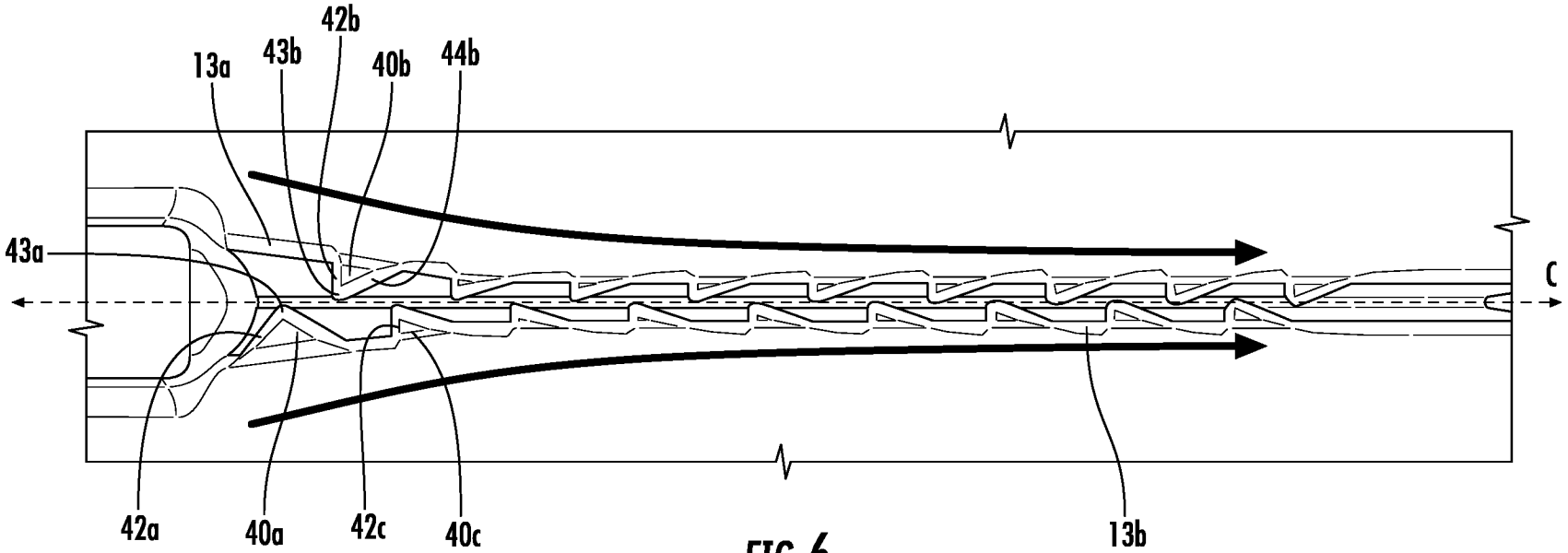
FIG. 6 is a flattened view highlighting the incremental narrowing within the snagging zone of the pick-up groove formed in the yarn carrier tube of FIGS. 2-5, in accordance with some embodiments of the present disclosure.

The center of the pick-up groove 15 may be a central azimuthal axis, as indicated by the axis "C" in FIG. 6. The central azimuthal axis may be the axis located equidistant from each of the distal-end-facing sidewall 13*a* and the adjacent-end-facing sidewall 13*b* of the pick-up groove 15.

Zones

As shown in FIG. 3, the pick-up groove 15 of the yarn carrier tube 10 may include different zones progressing around the yarn carrier tube 10 in the rotational winding direction "W". In some embodiments, the zones may include a gathering zone 12, a transition zone 14, and a snagging zone 16.

The gathering zone 12 may comprise a wide opening located at a leading end 15*a* of the pick-up groove 15. The leading end 15*a* may comprise the portion of the groove 15 that is first encountered by a yarn as the carrier tube is rotating in the rotational winding direction. In an embodiment, the leading end 15*a* may be adjacent the gathering zone 12. As shown in FIGS. 3-4, distal-end-facing sidewall 13*a* and adjacent-end-facing sidewall 13*b* may be substantially smooth and parallel within the gathering zone 12. The snagging zone 16 may comprise a narrowing opening and may be located adjacent a trailing end 15*b* of the pick-up groove 15. In some embodiments, the trailing end 15*b* is opposite the leading end 15*a*. The transition zone 14 may comprise an intermediate-sized opening and may be located between the gathering zone 12 and the snagging zone 16. As shown in FIGS. 3-4, distal-end-facing sidewall 13*a* and adjacent-end-facing sidewall 13*b* may be substantially smooth and parallel within the transition zone 12.

In some embodiments, the leading end 15*a* may be tapered, rounded, and/or otherwise smoothed in order to urge yarn into the pick-up groove 15. In other words, as the single strand 20 of yarn is guided in tension across the exterior surface 11*a* of the yarn carrier tube 10 toward the pick-up groove 15 in the longitudinal direction "T" (e.g., as shown in FIG. 1A), the yarn may first encounter the leading end 15*a* of the pick-up groove 15 (as the yarn carrier tube 10 is rotated in the rotational winding direction "W". The leading end 15*a* and/or the adjacent-end-facing sidewall 13*b* may be smoothed, beveled, and/or chamfered such that the yarn more easily or gently falls or glides into the gathering zone 12 of the pick-up groove 15 as the yarn is guided longitudinally away from the distal end (e.g., end 32 in FIG. 2) of the yarn carrier tube 10. In some embodiments (not shown), the exterior surface 11*a* of the yarn carrier tube 10 at the leading end 15*a* of the pick-up groove 15 may be tapered and/or depressed into the circumferential wall 60 of the yarn carrier tube 10, such that the yarn is urged toward one side of the pick-up groove 15 (e.g., the adjacent-end-facing sidewall 13*b*) in order to encounter structural features built-in to that side (e.g., the indentation 18 to one side of the fang 17, as discussed herein).

The gathering zone 12 may be the widest portion of the pick-up groove 15, in which the distance between the distal-end-facing sidewall 13*a* and the adjacent-end-facing sidewall 13*b* is greatest. The larger width between the sidewalls 13*a*, 13*b* in the gathering zone 12 may assist in capturing the single strand 20 of yarn.

The transition zone 14 may be narrower than the gathering zone 12 in order to urge the captured yarn toward the central azimuthal axis of the pick-up groove 15. The gripping or snagging zone 16 may include structural features (e.g., projections, teeth) for grabbing and holding/securing the yarn in place. The snagging zone 16 may include structural features configured to grab hold of the yarn as the yarn moves deeper into the snagging zone 16. As the yarn is grabbed by the snagging zone 16, the yarn may break off from the previous full yarn carrier tube in the winding machine 100 (e.g., forming an end tail 21, as seen in FIG. 1C) and begin winding around the new yarn carrier tube 10.

In operation, upon rotation of the yarn carrier tube 10, the yarn may be positioned substantially tangent to the exterior surface 11*a* of the circumferential wall 60 and in a generally circumferential direction along the pick-up groove 15. The yarn may drop into the gathering zone 12 and slide through the transition zone 14 into the snagging zone 16. After entering the snagging zone 16, the yarn may be engaged by the structural features, which hold the yarn in place, initiating winding (e.g., as seen in FIG. 1C).

In some embodiments, at least a portion of the snagging zone 16 may have a width between the sidewalls 13*a*, 13*b* and/or structural features that is less than the diameter of the yarn to be wound on the yarn carrier tube 10. Depending on the diameter of the yarn, this may occur at various locations within the snagging zone. For example, for a very narrow yarn, the width between the sidewalls 13*a*, 13*b* and/or structural features may be less than the diameter of the yarn near the trailing end 15*b* of the pick-up groove 15. In some embodiments, the transition zone 14 may be omitted and the snagging zone 16 may be positioned adjacent the gathering zone 12 of the pick-up groove 15.

Figure 5:
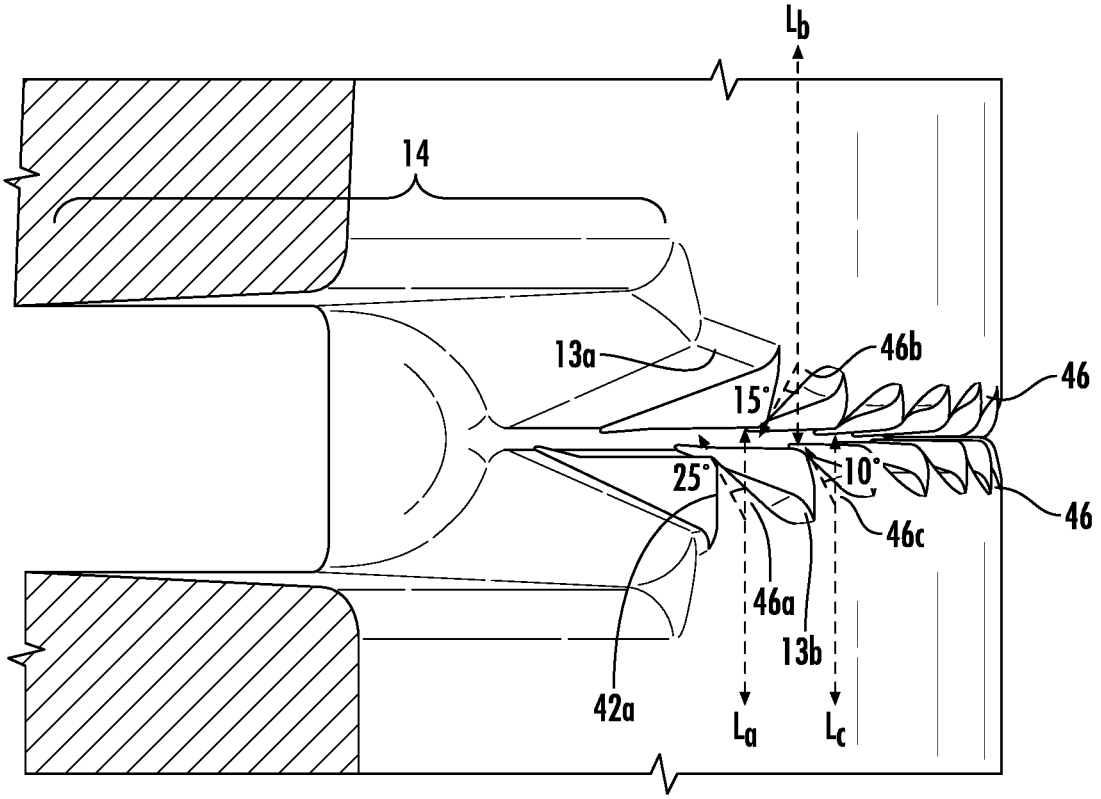
FIG. 5 is a cross-sectional view of a snagging zone of the pick-up groove formed in the yarn carrier tube of FIGS. 2-4, in accordance with some embodiments of the present disclosure.
Figure 11:
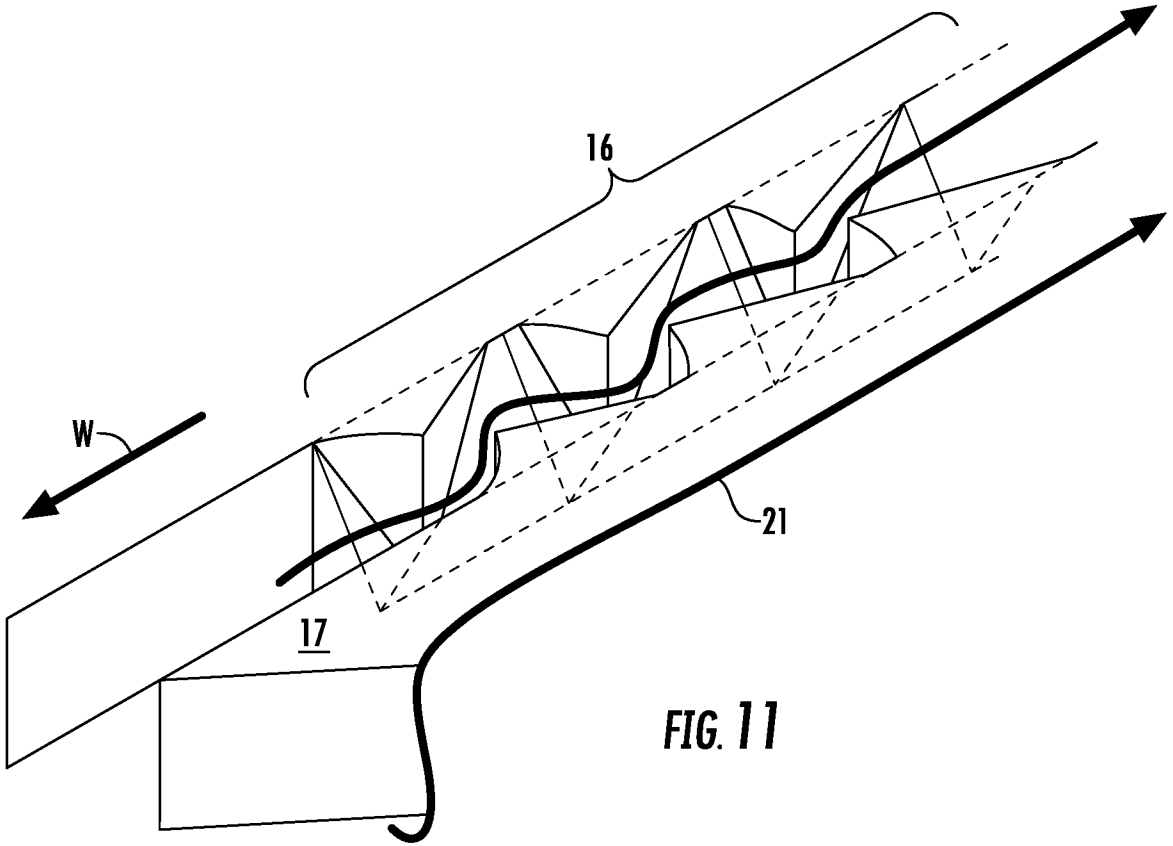
FIG. 11 is a magnified angled view of yarn snagging within an example pick-up groove, in accordance with some embodiments of the present disclosure.

As shown in FIG. 5, in some embodiments, within the snagging zone 16, the distal-end-facing sidewall 13*a* and adjacent-end-facing sidewall 13*b* may incrementally decrease the distance between themselves in the radial direction toward the longitudinal central axis "L" of the yarn carrier tube 10. In other words, a longitudinal cross-section of the snagging zone 16 may illustrate a V-shape for the distal-end-facing sidewall 13*a* and adjacent-end-facing sidewall 13*b*, with the widest open portion of the V located at the exterior radius "R" of the yarn carrier tube 10, facing the radially outward direction, such that the point of the V is pointed toward the longitudinal central axis "L" of the yarn carrier tube 10. In this way, as the yarn falls within the pick-up groove 15 and is hooked between the fang 17 and the previous full yarn carrier tube (e.g., as shown in FIGS. 1B and 11), the tension on the yarn combined with the rotational force of the yarn carrier tube 10 pulls the yarn both radially closer to the longitudinal central axis "L" and further into the snagging zone 16 toward the trailing end 15*b* of the pick-up groove 15. As additional length of yarn is pulled further into the pick-up groove 15, the yarn may be forced to zigzag between narrowing projections while being pulled radially deeper into the V-shape. Thus, the engagement of the yarn with the various structural features of the pick-up groove 15 may create enough surface area contact between the yarn and the specifically configured regions of the snagging zone 16 to result in a friction hold on the yarn. This friction hold may prevent the yarn from slipping as the yarn carrier tube 10 rotated, eventually resulting in the yarn breaking off from the previous full yarn carrier tube to create an end tail 21 (e.g., as shown in FIG. 1C) and allowing the yarn to become wound around the yarn carrier tube 10 (e.g., wound yarn 22 in FIG. 1C).

In some embodiments, the transition from the gathering zone 12 to the transition zone 14 and to the snagging zone 16 may be gradual. In other embodiments, the transition from the gathering zone 12 to the transition zone 14 and to the snagging zone 16 may be stepwise (e.g., the gathering zone 12 may step down to the transition zone 14 and then may step down to the snagging zone 16).

To improve the ability of the yarn carrier tube 10 to catch or snag the yarn as it is brought within the pick-up groove 15, the yarn carrier tube 10 of the present disclosure may include structural features within the pick-up groove 15 for frictionally holding the yarn.

Fang

In some embodiments, the structural features may include a fang 17. As shown in FIG. 1B, the fang 17 may initially snag the single strand 20 of yarn to introduce the yarn into the pick-up groove 15.

In some embodiments, the fang 17 may be located within or adjacent to the transition zone 14. In other embodiments, the fang 17 may be located within or adjacent to the gathering zone 12. In still other embodiments, the fang 17 may be located between the gathering zone 12 and the transition zone 14.

The fang 17 may project from a sidewall 13 of the pick-up groove 15. In some embodiments, the fang 17 may be formed to project from the distal-end-facing sidewall 13*a* or the adjacent-end-facing sidewall 13*b* (e.g., as shown in FIG. 4). The fang 17 may be generally shaped as a sharp triangle with two edges projecting from out of one sidewall (13*a* or 13*b*) and toward the other sidewall (13*a* or 13*b*). A first edge 17*a* of the fang 17 may be formed parallel or generally parallel to the rotational winding direction "W". As shown in FIG. 4, in some embodiments, the surface of the fang edge 17*a* facing toward the adjacent end 30 of the yarn carrier tube 10 may be parallel or substantially parallel to the distal-end-facing sidewall 13*a* of the pick-up groove 15.

In some embodiments, the second edge 17*b* of the fang 17 may be formed at an acute angle (e.g., about 45°) from the first edge 17*a*, such that its surface faces angularly toward the end of the yarn carrier tube 10 distal from the pick-up groove 15 (e.g., distal end 32 in FIG. 2). The intersection between the first and second edges 17*a*, 17*b* may form a tip 17*c* of the fang 17. The tip 17*c* of the fang 17 may generally point in the rotational winding direction "W" of the yarn carrier tube 10. In some embodiments, adjacent the fang 17, an indentation 18 may be formed into the sidewall 13 of the pick-up groove 15 from which the fang 17 projects. This indentation 18 may elongate the second edge 17*b* of the fang 17, as shown in FIGS. 3-4.

Teeth

In some embodiments, the structural features of the present disclosure may include a plurality of yarn-snagging projections (e.g., fingers, teeth) extending or projecting outwardly in the longitudinal direction from each of the sidewalls 13*a*, 13*b* and terminating within the pick-up groove 15 for frictionally engaging and grasping the yarn as it is brought within the pick-up groove 15. In some embodiments, these structural features are located within the snagging zone 16.

As shown in FIGS. 4-6, the projections of the pick-up groove 15 may comprise teeth 40. In some embodiments, the teeth 40 may be shaped generally as triangles, canine teeth, and/or shark fins. For example, as shown in FIG. 6, the pick-up groove 15 may include about eighteen (18) teeth 40. In some embodiments, the number of teeth 40 may range from about 5 to about 30, for example.

In some embodiments, one or more of the teeth 40 may have a triangular cross-section generally facing the radial direction, with two sides or edges projecting from the sidewall 13 and the base of the triangle built-in, sunk, and/or absorbed into the sidewall 13 from which it projects. In this way, for some teeth, one of the two edges faces generally toward the leading end 15*a* of the pick-up groove 15 (e.g., in the rotational winding direction "W"), and the other of the two edges faces generally toward the trailing end 15*b* of the pick-up groove 15 (e.g., in the direction opposite to the rotational winding direction "W"). In an embodiment, for example, the first several teeth may have edges are directed in a varied manner, but the remainder of the teeth may have edges that face generally toward the leading end 15*a* of the pick-up groove 15 and generally toward the trailing end 15*b* of the pick-up groove 15. While the teeth are referred to herein as having a triangular cross-section, it should be understood that the teeth may have any cross-section known in the art. For example, the teeth may have a rectangular or trapezoidal cross-section.

Each tooth 40 may include a leading edge 42 (i.e. a sidewall of the tooth that generally faces the leading edge 15*a* of the groove). The leading edge 42 (also referred to herein as 42*a*, 42*b*, 42*c*, etc.) may generally face in the rotational winding direction "W", such that the leading edge 42 would be the first portion of the tooth 40 encountered by the yarn as the yarn carrier tube 10 is rotated in the rotational winding direction "W", thereby moving the yarn deeper into the pick-up groove 15 (toward the trailing end 15*b*). In an embodiment, the leading edge 42 of one or more teeth 40 may be generally parallel (although may include some degree of curvature) to the longitudinal central axis "L" of the yarn carrier tube 10. Alternatively, one or more teeth 40 toward the leading end 15*a* of the pick-up groove 15 may be shaped (e.g., rounded with a fillet) such that the leading edge 42 of the tooth 40 generally forms (although may include some degree of curvature) an obtuse angle with the sidewall 13 from which the tooth 40 projects.

Figure 7:
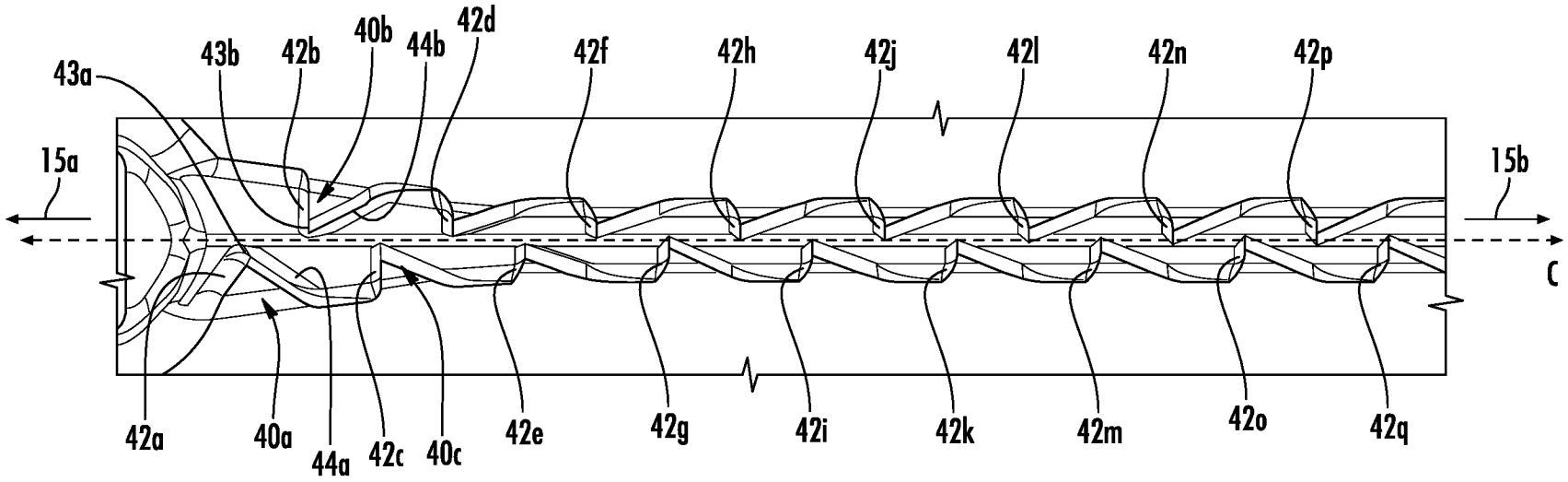
FIG. 7 is another view of the snagging zone of the pick-up groove formed in the yarn carrier tube of FIGS. 2-6, in accordance with some embodiments of the present disclosure.
Figure 9:
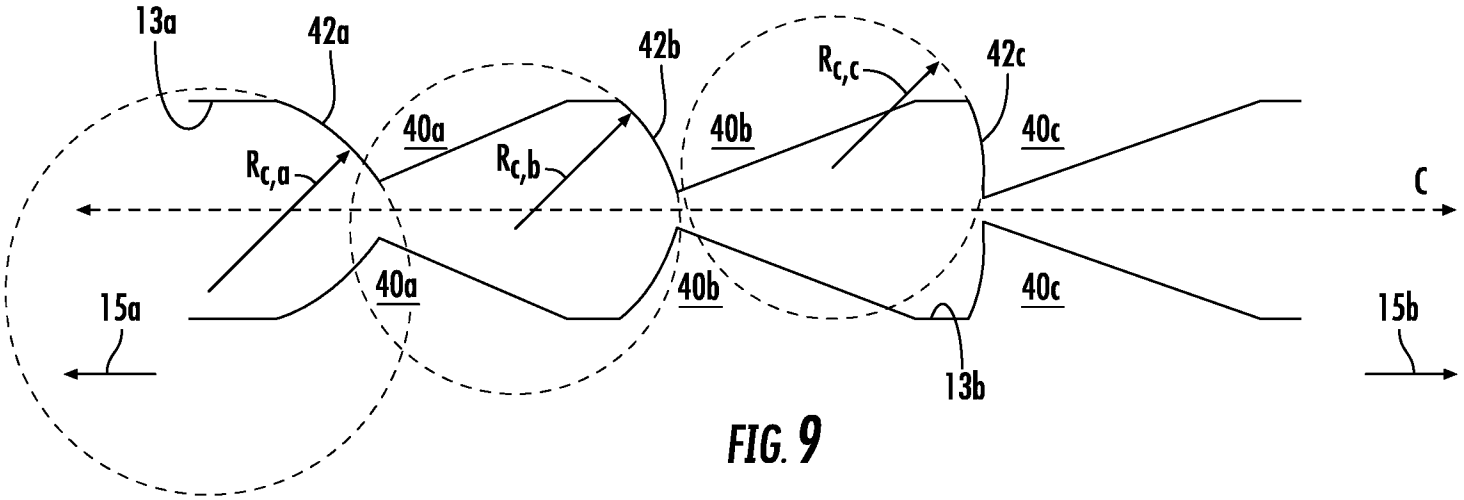
FIG. 9 is a magnified schematic view of aligned teeth within another example pick-up groove, in accordance with some embodiments of the present disclosure.

In some embodiments, the leading edge 42 of each of the teeth 40 may have a radius of curvature (e.g., as indicated by the radius "$R_c$" or "$R_{c,a}$" in FIGS. 7 and 9). For example, the $R_c$ of leading edge 42*q* is shown in FIG. 7 and the $R_c$ of leading edges 42*a*, 42*b*, and 42*c* are shown in FIG. 9. The radius of curvature may range from about 0.01 in. to about 0.003 in., for example. In some embodiments, all (or a majority) of the teeth 40 within the pick-up groove 15 may have substantially the same radius of curvature "$R_c$" (e.g., about 0.004 in.). In an embodiment, the radius of curvature of each leading edge 42 decreases from the leading end 15*a* to the trailing end 15*b*.

Each tooth 40 may include a degree of sharpness based on the radius of curvature formed by the leading edge 42—where the smaller the radius of curvature, the sharper the tooth 40 (e.g., the higher the degree of sharpness). For example, as shown in FIG. 7, the first tooth 40*a* may have a first degree of sharpness due to the radius of curvature of the first leading edge 42*a*. The second tooth 40*b* may have a second degree of sharpness due to the radius of curvature of the second leading edge 42*b*. The third tooth 40*c* may have a third degree of sharpness due to the radius of curvature of the second leading edge 42*c*. In some embodiments, the first degree of sharpness may be less than the second degree of sharpness. In some embodiments, the second degree of sharpness may be less than the third degree of sharpness.

As another example, FIG. 9 shows a plurality of teeth, comprising a first set of teeth projecting from a first sidewall 13*a* and a second set of teeth projecting from a second sidewall 13*b*. As shown in FIG. 9, the first and second sets of teeth are aligned with each other (rather than offset as the teeth 40 in FIGS. 6-8). Additionally, each aligned pair of teeth (e.g., teeth 40*a*) are symmetrical about the central azimuthal axis "C" of the pick-up groove 15. The first leading edge 42*a* of either of the aligned symmetrical first teeth 40*a* has a radius of curvature "$R_{c,a}$". The second leading edge 42*b* of either of the aligned symmetrical second teeth 40*b* has a radius of curvature "$R_{c,b}$". The radius of curvature "$R_{c,b}$" of the second leading edge 42*b* is smaller than the radius of curvature "$R_{c,a}$" of the first leading edge 42*a*. Thus, the second teeth 40*b* are sharper (or have a higher degree of sharpness) than the first teeth 40*a*. This increasing sharpness of the teeth 40 may continue in the direction opposite the rotational winding direction "W". Accordingly, the third leading edge 42*c* of either of the aligned symmetrical third teeth 40*c* has a radius of curvature "$R_{c,c}$", which is smaller than the radius of curvature "$R_{c,a}$" of the first leading edge 42*a* and/or the radius of curvature "$R_{c,b}$" of the second leading edge 42*b*. In this way, the third teeth 40*c* are sharper than the second teeth 40*b*, and the second teeth 40*b* are sharper than the first teeth 40*a*. In some embodiments, rather than continue to increase in sharpness, the remaining teeth 40 within the pick-up groove 15 may all have substantially the same degree of sharpness as the third tooth 40*c*, in an embodiment.

Each tooth 40 may further include a trailing edge 44. The trailing edge 44 (also referred to herein as 44*a*, 44*b*, 44*c*, etc.) may generally face the direction opposite the rotational winding direction "W" (e.g., toward the trailing end 15*b* of the pick-up groove 15), such that the trailing edge 44 would be encountered first by the yarn if the yarn was moving out of the snagging zone 16 (away from the trailing end 15*b*) in the direction opposite to the rotational winding direction "W" (toward the leading end 15*a* of the pick-up groove 15). The trailing edge 44 of each tooth 40 may form an obtuse angle (e.g., about 150°) with the sidewall 13 of the pick-up groove 15 from which the tooth 40 projects.

A point or tip 43 may be formed on each tooth 40 where the leading edge 42 meets the trailing edge 44. In this way, the tip 43 of each tooth 40 is the point most distal from the sidewall 13 of the pick-up groove 15 from which the tooth 40 projects.

In some embodiments, teeth 40 may project from the sidewall 13 such that there is little to no separation between a trailing edge 44 of a tooth 40 and the next leading edge 42 of an adjacent tooth 40 projecting from the same sidewall (e.g., first sidewall 13*a*). In other embodiments, adjacent teeth 40 projecting from the same sidewall (e.g., first sidewall 13*a*) may have longer lengths of sidewall 13 between their respective trailing edge 44 and leading edge 42. Between adjacent teeth 40 projecting from the same sidewall (e.g., first sidewall 13*a*), the sidewall 13 may extend in the circumferential direction substantially parallel to the ends 30, 32 of the yarn carrier tube 10 and perpendicular to the longitudinal central axis "L". The size of each tooth 40 may be measured by the longitudinal distance from the tip 43 to the circumferential line extending from the sidewall 13 from which the tooth 40 projects.

While moving from the gathering zone 12 into the snagging zone 16, a first tooth 40*a* of the plurality of teeth 40 may be encountered. In some embodiments, the leading edge 42*a* of the first tooth 40*a* may be formed such that it forms an obtuse angle with the sidewall (e.g., adjacent-end-facing sidewall 13*b*) from which the first tooth 40*a* projects. In this way, as yarn moves from the gathering zone 12 into the snagging zone 16, the leading edge 42*a* of the first tooth 40*a* guides the yarn further into the snagging zone 16. As shown in FIGS. 3-6, the first tooth 40*a* may project from the adjacent-end-facing sidewall 13*b*. Alternatively, however, the first tooth 40*a* may project from the distal-end-facing sidewall 13*a*.

In some embodiments, the teeth 40 may be formed offset from each other, such that the tip 43 of a tooth 40 (e.g., second tooth 40*b*) projecting from the distal-end-facing sidewall 13*a* is positioned between the tips (e.g., first and third tooth tips 43*a*, 43*c*) of adjacent teeth 40 projecting toward it from the adjacent-end-facing sidewall 13*b*. In this way, after encountering the first tooth 40*a* projecting from the adjacent-end-facing sidewall 13*b* while moving from the gathering zone 12 into the snagging zone 16, the yarn would encounter a second tooth 40*b* projecting from the opposite distal-end-facing sidewall 13*a* as the yarn moved further into the snagging zone 16.

In some embodiments (e.g., as shown in FIGS. 6-7), the leading edge 42*b* of the second tooth 40*b* may be generally parallel (although may include some degree of curvature) to the longitudinal central axis "L" of the yarn carrier tube 10. The leading edge 42*b* of the second tooth 40*b* may have a radius of curvature of about 0.004 in., for example.

In operation, as the yarn moves further into the snagging zone 16 of the pick-up groove 15, it may encounter a third tooth 40*c*, projecting from the adjacent-end-facing sidewall 13*b* of the pick-up groove 15.

In some embodiments (e.g., as shown in FIG. 4), at the trailing end 15*b* of the pick-up groove 15 after the teeth 40, there may be a portion of the snagging zone 16 without teeth 40, where the distal-end-facing sidewall 13*a* and adjacent-end-facing sidewall 13*b* are smooth and parallel to each other. Alternatively, in some embodiments, there may be a toothless portion of the snagging zone 16 after the teeth 40 at the trailing end 15*b* of the pick-up groove 15 where the distal-end-facing sidewall 13*a* and adjacent-end-facing sidewall 13*b* continue to incrementally narrow toward each other until meeting at a point. In other embodiments, the teeth 40 of the snagging zone 16 may continue all the way to the trailing end 15*b* of the pick-up groove 15.

In some embodiments, the tips 43 of the teeth may be offset in a manner in which the lateral distance between the tips are different. Referencing FIG. 8, the lateral distance (e.g., indicated as "$D_{ab}$" in FIG. 8) between tip 43*a* (first tooth) and tip 43*b* (second tooth) may be less than the lateral distance "$D_{bc}$" between tip 43*b* and tip 43*c*. Likewise, the lateral distance "$D_{cd}$" between tip 43*c* (third tooth) and tip 43*d* (fourth tooth) may be less than the lateral distance "$D_{bc}$" between tip 43*b* and tip 43*c* or the lateral distance between tip 43*d* and 43*e*. Such a configuration may provide an increased likelihood of snagging a yarn between offset teeth 40*a*/40*b* or 40*c*/40*d*, for example.

Adaptable Snagging Feature

In some embodiments, the structural features of the pick-up groove 15 may include one or more adaptable snagging features for adaptability to various yarn diameters, weights, thicknesses, and/or deniers. Additionally, in some embodiments, the structural features of the pick-up groove 15 may include one or more adaptable snagging features for adaptability to various yarn materials.

Incremental Narrowing

In some embodiments, the adaptable snagging feature of the pick-up groove 15 may include incremental narrowing, as highlighted by the red arrows in FIG. 6, for example. For example, the end of the snagging zone 16 nearest the transition zone 14 and leading end 15*a* may begin wide enough to accommodate the largest thickness of yarn, and as the pick-up groove 15 continues around the circumference of the yarn carrier tube 10 toward the trailing end 15*b* (e.g., as the yarn moves from the gathering zone 12 into the snagging zone 16 and away from the gathering zone 12), the tips 43 of the teeth 40 may be progressively closer to one another and may cross the central azimuthal axis "C" of the pick-up groove 15.

Figure 10:
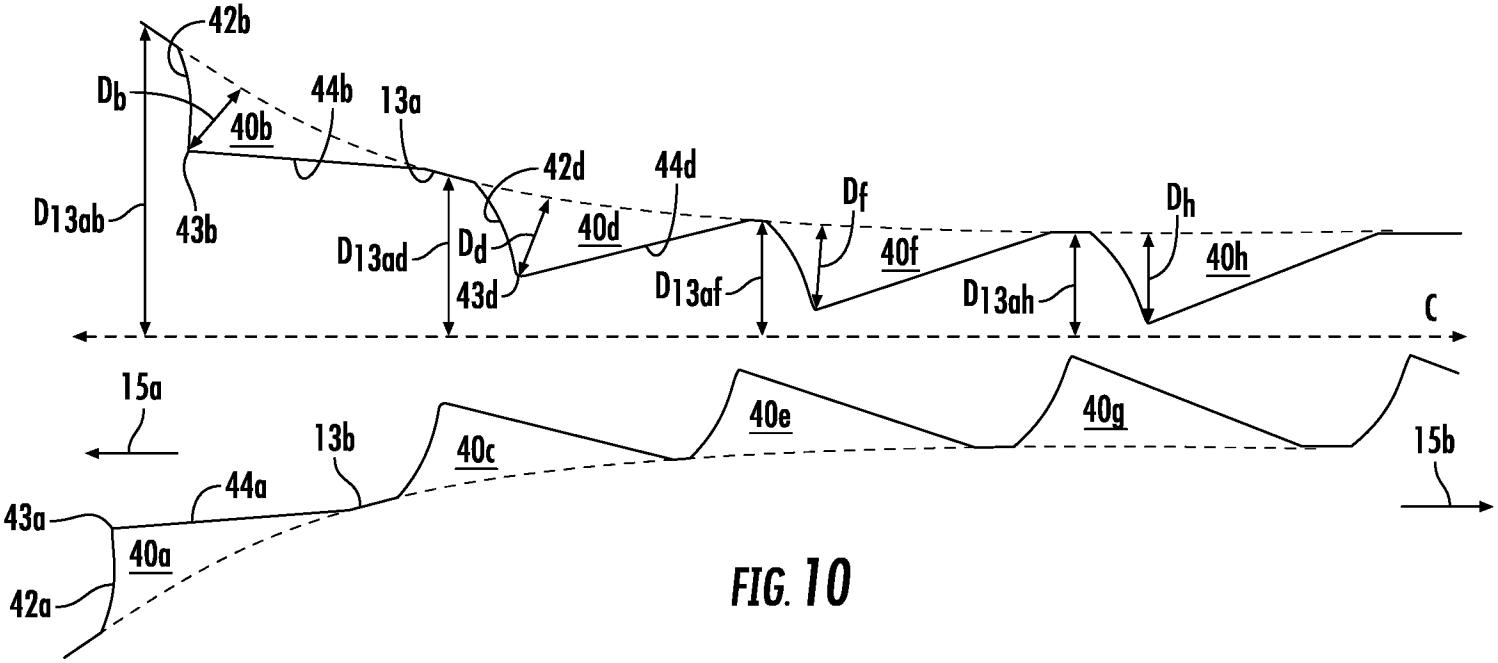
FIG. 10 is a magnified schematic view of offset teeth within an example pick-up groove with incrementally narrowing sidewalls, in accordance with some embodiments of the present disclosure.

In some embodiments, some, all, or most of the teeth 40 may be substantially the same size (e.g., with the same distance between the tip 43 and the sidewall 13 from which the tooth 40 projects). In such embodiments, the incremental narrowing with the tips 43 being progressively closer to one another may be due to the distance between the sidewalls 13 (e.g., not including the projections or teeth 40 extending therefrom) incrementally decreasing in the direction opposite to the rotational winding direction "W" (e.g., as the yarn moves further into the snagging zone 16). As shown in FIG. 10, for example, the distance "$D_{13ab}$" between the distal-end-facing sidewall 13*a* and the central azimuthal axis "C" before the second tooth 40*b* is greater than the distance "$D_{13ad}$" between the distal-end-facing sidewall 13*a* and the central azimuthal axis "C" before the fourth tooth 40*d*. This incremental narrowing may continue as the distance "$D_{13af}$" between the distal-end-facing sidewall 13*a* and the central azimuthal axis "C" before the sixth tooth 40*f* is greater than the distance "$D_{13ah}$" between the distal-end-facing sidewall 13*a* and the central azimuthal axis "C" before the eighth tooth 40*h*. Meanwhile, the size of the teeth 40*b*, 40*d*, 40*f*, 40*h*—as measured by the distance between the distal-end-facing sidewall 13*a* and the tip 43 of the tooth 40 (e.g., as indicated by distances "$D_b$", "$D_d$", "$D_f$", "$D_h$" in FIG. 10)—may remain constant.

Additionally or alternatively, in some embodiments, the incremental narrowing may be due to the teeth 40 increasing in size (e.g., distance from sidewall 13 to tip 43) in the direction opposite to the rotational winding direction "W".

Figure 8:
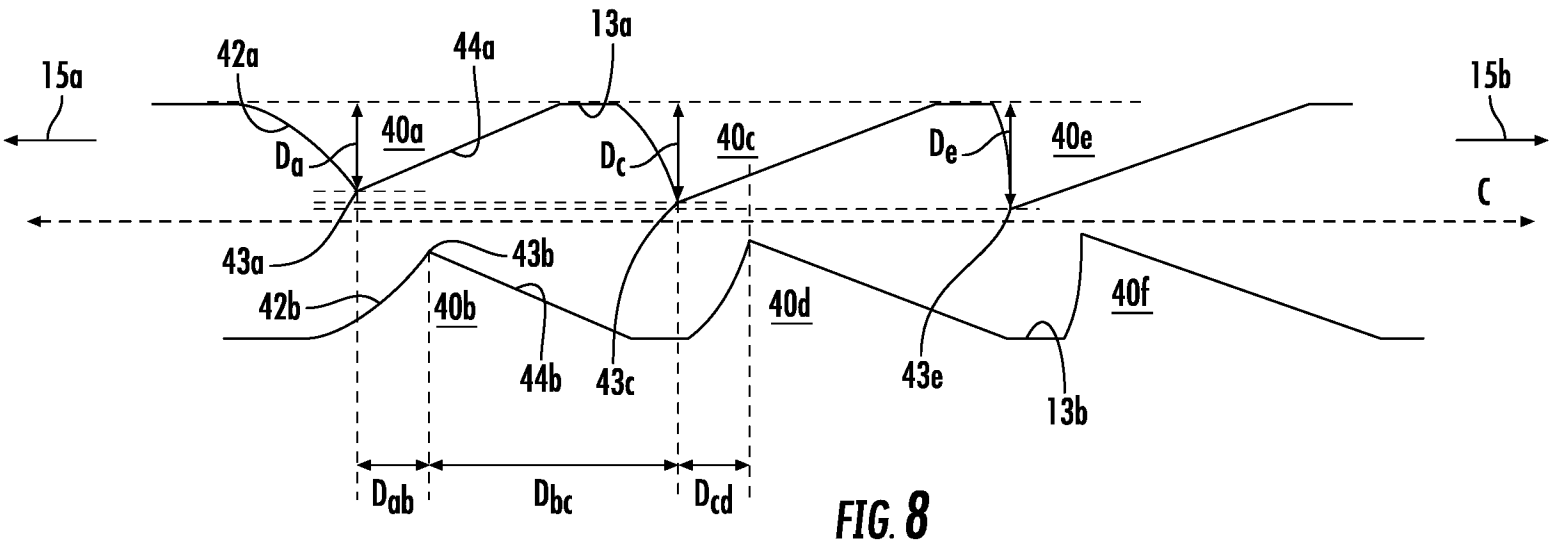
FIG. 8 is a magnified schematic view of offset teeth within an example pick-up groove, in accordance with some embodiments of the present disclosure.

For example, FIG. 8 shows a plurality of teeth, comprising a first set of teeth 40*a*, 40*c*, 40*e* projecting from a first sidewall 13*a* and a second set of teeth 40*b*, 40*d*, 40*f* projecting from a second sidewall 13*b*. As shown in FIG. 8, the first and second sets of teeth project from opposite sides of the pick-up groove 15 and are offset from each other (e.g., such that the tips 43 of each tooth are not longitudinally aligned with another tip 43). Additionally, each leading pair of teeth (e.g., teeth 40*a*, 40*b*) may be offset, but substantially symmetrical about the central azimuthal axis "C" of the pick-up groove 15 (e.g., pairs of opposing offset teeth may have substantially the same size). The first tooth 40*a* has a first size "$D_a$", which is the longitudinal distance from the circumferential line of the first sidewall 13*a* (parallel to the ends 30, 32 of the yarn carrier tube 10) to the first tip 43*a*. In some embodiments, a second size of the second tooth 40*b* may be substantially the same as the first size "$D_a$" of the first tooth 40*a*, where the second size of the second tooth 40*b* is measured as the longitudinal distance from the circumferential line of the second sidewall 13*b* (parallel to the ends 30, 32 of the yarn carrier tube 10) to the second tip 43*b*. The third tooth 40*c* has a third size "$D_c$", which is the longitudinal distance from the circumferential line of the first sidewall 13*a* (parallel to the ends 30, 32 of the yarn carrier tube 10) to the third tip 43*c*. The third size "$D_c$" of the third tooth 40*c* may be greater than the first size "$D_a$" of the first tooth 40*a*. In this way, the first and second sets of teeth 40 may increase in size toward the trailing end 15*b* of the pick-up groove 15. Accordingly, the fifth tooth 40*e* has a fifth size "$D_e$" (the longitudinal distance from the circumferential line of the first sidewall 13*a* to the fifth tip 43*e*), which is greater than the third size "$D_c$" of the third tooth 40*c*. Thus, the distance from the fifth tip 43*e* to the central azimuthal axis "C" of the pick-up groove 15 is less than the distance from the third tip 43*c* to the central azimuthal axis "C". By increasing in size in the direction opposite to the rotational winding direction "W", the teeth 40 further into the pick-up groove 15 (nearer to the trailing end 15*b*) may have decreasing distances from their tips 43 to the central azimuthal axis "C" of the pick-up groove 15.

In some embodiments (e.g., as shown in FIG. 6), the tips 43 of one or more of the offset teeth 40 may extend past the central azimuthal axis "C" of the pick-up groove 15. That is, one or more tips 43 may extend from the first or second sidewall 13*a*, 13*b* past a circumferential line set by the longitudinal distance between the first and second sidewall 13*a*, 13*b*. For example, the overlap may be about 0.005 in. In some embodiments, the overlap may range from 0 to about 0.01 in.

In some embodiments, teeth 40 near the leading end 15*a* of the pick-up groove 15 may start off with a gap (e.g., about 0.008 in.) between the opposing and offset, first tip 43*a* and second tip 43*b*. The distance between the tips on one side 13*a* and the tips on the other side 13*b* may decrease in the direction opposite to the rotational winding direction "W" (e.g., toward the trailing end 15*b* of the pick-up groove 15), such that the gap is closed and the opposite-side tips 43 begin to overlap. In this way, as the yarn is moved further into the pick-up groove 15 (toward the trailing end 15*b*), there is an increasing likelihood that the interlocking teeth 40 may frictionally hold the yarn.

Increasing Sharpness of Teeth

In some embodiments, the adaptable snagging feature for different types of yarn may include increasing sharpness of the teeth 40. The teeth 40 increase in sharpness (e.g., due to successively reduced radii of curvature for the leading edges 42) as the yarn moves further into the pick-up groove 15 (toward the trailing end 15*b*). Having sharper teeth 40 located further into the snagging zone 16 toward the trailing end 15*b* of the pick-up groove 15 may provide more friction to grab and break off the yarn from the previous full yarn carrier tube.

The first tooth 40*a* may have a smooth leading edge 42*a* (e.g., rounded with a 0.010 in. fillet) to guide yarn deeper into the snagging zone 16 of the pick-up groove 15.

Teeth Depressed into Surface

In some embodiments, the structural features may include the teeth 40 being depressed at an angle into the circumferential wall 60 of the yarn carrier tube 10. In such embodiments, as shown in FIG. 5, the radially outward-facing surfaces 46 of one or more of the teeth 40 may be angled into the exterior surface 11*a* of the yarn carrier tube 10 (e.g., by about 10°) to more easily guide the yarn deeper into the snagging zone 16 of the pick-up groove 15. In other words, outside of the empty space circumscribed by the sidewalls 13 of the pick-up groove 15, the exterior surface 11*a* of the yarn carrier tube 10 may not parallel to the longitudinal central axis "L" at all points around the circumference of the yarn carrier tube 10. Rather, at some points or in some regions around the sidewalls 13 of the pick-up groove 15, the radially outward-facing exterior surface 11*a* may be chamfered, beveled, or otherwise depressed at an angle toward the longitudinal central axis "L" of the yarn carrier tube 10. Within such regions, the thickness of the circumferential wall 60 may be less than the difference between the exterior radius "R" and interior radius "r", as shown in FIG. 2. This chamfering, beveling, and/or depressed configuration of the exterior surface 11*a* may aid in guiding the yarn across the exterior surface 11*a* of the rotating yarn carrier tube 10 and causing the yarn to fall or smoothly glide into the pick-up groove 15 to be engaged by its structural features thereafter.

In some embodiments, the radially outward-facing surface 46*a* of the first tooth 40*a* may be angled into the circumferential wall 60 of the yarn carrier tube 10 at a first angle of depression with respect to the longitudinal central axis "L" of the yarn carrier tube 10. The first angle of depression may be greater than the angles of depression of the other teeth 40. The first angle of depression may fall within the range of about 5° to about 45°. As shown in FIG. 5, in some embodiments, the first angle of depression may be about 25° with respect to the longitudinal central axis "L".

In some embodiments, the radially outward-facing surface 46*b* of the second tooth 40*b* may be angled into the circumferential wall 60 of the yarn carrier tube 10 at a second angle of depression with respect to the longitudinal central axis "L" of the yarn carrier tube 10. The second angle of depression may be greater than the angles of depression of the other teeth 40 (other than the first tooth), in an embodiment. The second angle of depression may fall within the range of about 5° to about 40°. As shown in FIG. 5, in some embodiments, the second angle of depression may be about 15° with respect to the longitudinal central axis "L".

In some embodiments, the teeth 40 nearest the leading end 15*a* of the pick-up groove 15 may have greater angles of depression than the remaining teeth 40 toward the trailing end 15*b* of the pick-up groove 15. For example, as shown in FIG. 5, the first angle of depression of the first radially outward-facing surface 46*a* of the first tooth 40*a* may be about 25° with respect to the longitudinal central axis "L", the second angle of depression of the second radially outward-facing surface 46*b* of the second tooth 40*b* may be about 15° with respect to the longitudinal central axis "L", the third angle of depression of the third radially outward-facing surface 46*c* of the third tooth 40*c* may be about 10° with respect to the longitudinal central axis "L", and the radially outward-facing surfaces 46 of the remaining teeth 40 may also be angled into the circumferential wall 60 at an angle of depression of about 10° with respect to the longitudinal central axis "L".

In some embodiments, the angle of depression of the radially outward-facing surface 46 of the teeth 40 may incrementally decrease in the direction opposite to the rotational winding direction "W" (e.g., toward the trailing end 15*b* of the pick-up groove 15).

In some embodiments, the angle of depression of the radially outward-facing surface 46 of the first few teeth 40 closest to the leading end 15*a* of the pick-up groove 15 may incrementally decrease in the direction opposite to the rotational winding direction "W" (e.g., toward the trailing end 15*b* of the pick-up groove 15), while the radially outward-facing surfaces 46 of the majority of the teeth 40 have substantially the same angle of depression. For example, in some embodiments, the majority of the radially outward-facing surfaces 46 of the teeth 40 may be angled into the circumferential wall 60 at an angle of depression of about 0° with respect to the longitudinal central axis "L".

Longitudinal Orientation

The yarn carrier tube 10 may be directionally and/or orientation-dependent, such that the orientation of the ends 30, 32 with respect to the spindle 150 matters to the operation of the yarn carrier tube 10 in its ability to initiate winding of the yarn onto itself. This may be true where there is one pick-up groove 15 formed at one end (e.g., adjacent end 30) of the yarn carrier tube 10. Depending on the direction of rotation and the position of the yarn with respect to the end (e.g., adjacent end 30) of the yarn carrier tube 10 with the pick-up groove 15, the yarn carrier tube 10 may have to be loaded onto the spindle 150 of the winding machine 100 in a specific longitudinal orientation in order for the pick-up groove 15 to be properly oriented with respect to the yarn such that the pick-up groove 15 may initiate winding of the yarn onto the yarn carrier tube 10.

In some embodiments, the yarn carrier tube may include multiple pick-up grooves. Specifically, the yarn carrier tube may include two pick-up grooves formed near each end, wherein the pick-up grooves are not formed to be the same and instead have some variation between their respective structural features. For example, a first pick-up groove may include structural features configured for a particular range of diameters, whereas a second pick-up groove may include structural features specifically configured for a different range of diameters. As another example, a first pick-up groove may include structural features configured for a particular material or texture of yarn, whereas a second pick-up groove may include structural features tested and best suited for a different set of textures (e.g., smoothness, frictional qualities). In this way, the preferred orientation when loading the yarn carrier tube onto the spindle of the winding machine may depend on the type of yarn being fed to the winding machine. In such embodiments, the yarn carrier tube may include indications (e.g., markings, coloring, printed matter) of the different ends and/or orientations. For example, the indications may include the type of yarn (e.g., diameter ranges, texture classes) best suited for each orientation and which end should go where within the winding machine depending on the type of yarn being fed to the winding machine. In some embodiments, the yarn carrier tube may be integrally formed or assembled from multiple materials. For example, each end and/or pick-up groove may comprise or be coated with a specific material specifically configured for particular yarn materials or classes. Similarly, each end and/or pick-up groove may include different textures and/or surface patterns configured for specific yarn materials or classes. Any differences between the ends may be designated by the indications described herein.

Alternatively, in some embodiments, the yarn carrier tube may not be rotation and/or orientation-dependent. For example, the yarn carrier tube may be configured to be reversible with two pick-up grooves—each including the same (or substantially similar) structural features formed near opposite ends of the yarn carrier tube. In this way, when the empty yarn carrier tube is loaded onto the mandrel or spindle of the winding machine, the orientation of the ends (e.g., the direction of rotation of the yarn carrier tube) may not affect the functioning of the yarn carrier tube with regard to the structural features of either pick-up groove as they relate to initiating winding of the yarn onto the yarn carrier tube.

Method of Manufacture

In some embodiments, the yarn carrier tube 10 may be formed from plastic or resin. For example, the yarn carrier tube 10 may be injection molded from plastic. Other methods of manufacture of the yarn carrier tube are contemplated, such as 3D printing, for example.

Many modifications and other embodiments of the present disclosure set forth herein will come to mind to one skilled in the art to which the present disclosure pertains having the benefit of the teachings presented in the foregoing descriptions and the associated drawings. Therefore, it is to be understood that the present disclosure is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A reusable yarn carrier tube for winding yarns of various thicknesses thereon at high speeds as the carrier tube is rotated in a rotational winding direction, the carrier tube comprising:

a circumferential wall; and a pick-up groove formed through and extending along the azimuthal direction of the circumferential wall, circumscribed by a sidewall, wherein the pick-up groove comprises:

a plurality of teeth projecting from the sidewall of the pick-up groove toward a central azimuthal axis of the pick-up groove, wherein the distance between the teeth, as measured across the pick-up groove in the longitudinal direction of the circumferential wall, decreases in a direction opposite to the rotational winding direction.

2. The yarn carrier tube of claim 1, wherein:

each tooth in the plurality of teeth includes a leading edge facing the rotational winding direction, each leading edge having a degree of sharpness, and the plurality of teeth comprises:

a first tooth with a first degree of sharpness, and a second tooth with a second degree of sharpness, wherein the first degree of sharpness is less than the second degree of sharpness.

3. The yarn carrier tube of claim 2, wherein:

the first tooth has a radially outward-facing surface angled toward a longitudinal central axis of the carrier tube at a first angle.

4. The yarn carrier tube of claim 3, wherein:

the second tooth has a radially outward-facing surface angled toward the longitudinal central axis of the carrier tube at a second angle, and the first angle is greater than the second angle.

5. The yarn carrier tube of claim 3, wherein:

radially outward-facing surfaces of a majority of the plurality of teeth are angled toward the longitudinal central axis of the carrier tube at a second angle, and the first angle is greater than the second angle.

6. The yarn carrier tube of claim 5, wherein:

the second tooth has a radially outward-facing surface angled toward the longitudinal central axis of the carrier tube at a third angle, and the third angle is greater than the second angle.

7. The yarn carrier tube of claim 5, wherein the second angle is about 10°.

8. The yarn carrier tube of claim 3, wherein the first angle is about 25°.

9. The yarn carrier tube of claim 1, wherein:

each tooth of the plurality of teeth includes a leading edge generally facing the rotational winding direction, each leading edge having a degree of sharpness, and the degree of sharpness of the leading edge of the teeth increases in a direction opposite to the rotational winding direction.

10. The yarn carrier tube of claim 9, wherein the plurality of teeth comprises:

a first tooth having a lowest degree of sharpness such that the leading edge of the first tooth forms a smooth guiding surface for leading the yarn further into the pick-up groove in the direction opposite to the rotational winding direction.

11. The yarn carrier tube of claim 9, wherein the degree of sharpness of the leading edge is based on a radius of curvature of the leading edge.

12. The yarn carrier tube of claim 1, wherein:

the plurality of teeth comprises:

a first set of teeth projecting from a first sidewall of the pick-up groove toward the central azimuthal axis of the pick-up groove, and a second set of teeth projecting from a second sidewall of the pick-up groove toward the first set of teeth and the central azimuthal axis of the pick-up groove; and each tooth within the first set of teeth is offset from each tooth within the second set of teeth.

13. The yarn carrier tube of claim 1, wherein:

each tooth within the plurality of teeth has a tip, distal from the sidewall of the pick-up groove from which the tooth projects; and the tip of at least one tooth of the plurality of teeth extends past the central azimuthal axis.

14. The yarn carrier tube of claim 1, further comprising:

a fang for initially snagging the yarn into the pick-up groove, wherein the fang includes a tip pointing in the rotational winding direction.

15. The yarn carrier tube of claim 1, wherein the pick-up groove includes a plurality of zones, in which the width of the pick-up groove in each zone decreases in a direction opposite to the rotational winding direction.

16. The yarn carrier tube of claim 15, wherein the plurality of zones includes at least one of a gathering zone, a transition zone, and a snagging zone.

17. The yarn carrier tube of claim 15, wherein the plurality of zones includes a third zone, in which an adaptable snagging feature is located.

18. The yarn carrier tube of claim 1, wherein:

each tooth within the plurality of teeth has a tip, distal from the sidewall of the pick-up groove from which the tooth projects; and the distance between the sidewall from which each tooth projects to the tip of each tooth is substantially the same.

19. The yarn carrier tube of claim 1, wherein:

each tooth within the plurality of teeth has a tip, distal from the sidewall of the pick-up groove from which the tooth projects; and the distance between the sidewall from which each tooth projects to the tip of each tooth increases in the direction opposite to the rotational winding.

20. The yarn carrier tube of claim 1, wherein the carrier tube is formed from plastic.

21. The yarn carrier tube of claim 1, wherein the carrier tube is molded.

22. A reusable yarn carrier tube for winding yarns thereon as the carrier tube is rotated in a rotational winding direction at high speeds, the carrier tube comprising:

a circumferential wall formed cylindrically with an exterior surface, an interior surface, and two ends; and a pick-up groove:

adjacent to an adjacent end of the two ends, and distal from a distal end of the two ends, formed through and extending along the azimuthal direction of the circumferential wall, circumscribed by sidewalls including an adjacent-end-facing sidewall and a distal-end-facing sidewall, and comprising a plurality of teeth projecting from the sidewalls of the pick-up groove toward a central azimuthal axis of the pick-up groove, wherein each tooth of the plurality of teeth comprises:

a radially outward-facing surface, a leading edge configured to first encounter yarn moving further into the pick-up groove as the carrier tube is rotated in the rotational winding direction, a trailing edge positioned opposite the leading edge, and a tip, where the leading edge and the trailing edge meet, distal from the sidewall from which the tooth projects, wherein the degree of sharpness of the teeth increases in a direction opposite to the rotational winding direction.

23. The yarn carrier tube of claim 22, wherein the degree of sharpness of each tooth is based on a radius of curvature of the leading edge of the tooth.

24. The yarn carrier tube of claim 22, wherein the plurality of teeth comprises:

a first tooth wherein the leading edge forms an obtuse angle with the sidewall from which the first tooth projects.

25. The yarn carrier tube of claim 22, wherein the plurality of teeth comprises:

a first tooth wherein the radially outward-facing surface is angled toward a longitudinal central axis of the carrier tube at a first angle.

26. The yarn carrier tube of claim 25, wherein the plurality of teeth further comprises:

a second tooth wherein the radially outward-facing surface is angled toward the longitudinal central axis of the carrier tube at a second angle, wherein the first angle is greater than the second angle.

27. The yarn carrier tube of claim 25, wherein:

the radially outward-facing surfaces of a majority of the plurality of teeth are angled toward the longitudinal central axis of the carrier tube at a second angle, and the first angle is greater than the second angle.

28. The yarn carrier tube of claim 27, wherein the plurality of teeth further comprises:

a second tooth wherein the radially outward-facing surface is angled toward the longitudinal central axis of the carrier tube at a third angle, wherein third angle is greater than the second angle.

29. The yarn carrier tube of claim 27, wherein the second angle is about 10°.

30. The yarn carrier tube of claim 25, wherein the first angle is about 25°.

31. The yarn carrier tube of claim 22, wherein:

the plurality of teeth comprises:

a first set of teeth projecting from the adjacent-end-facing sidewall of the pick-up groove toward the central azimuthal axis of the pick-up groove, and a second set of teeth projecting from the distal-end-facing sidewall of the pick-up groove toward the first set of teeth and the central azimuthal axis of the pick-up groove; and each tooth within the first set of teeth is offset from each tooth within the second set of teeth.

32. The yarn carrier tube of claim 22, wherein the tip of at least one tooth of the plurality of teeth extends past the central azimuthal axis of the pick-up groove.

33. The yarn carrier tube of claim 22, further comprising:

a fang for initially snagging the yarn into the pick-up groove, wherein the fang includes a tip pointing in the rotational winding direction.

34. The yarn carrier tube of claim 22, wherein the pick-up groove incrementally narrows in the direction opposite to the rotational winding direction.

35. The yarn carrier tube of claim 34, wherein the distance between the sidewall from which each tooth projects to the tip of each tooth is substantially the same.

36. The yarn carrier tube of claim 34, wherein the distance between the sidewall from which each tooth projects to the tip of each tooth increases in the direction opposite to the rotational winding.

37. The yarn carrier tube of claim 22, wherein the carrier tube is formed from plastic.

38. The yarn carrier tube of claim 22, wherein the carrier tube is molded.

39. The yarn carrier tube of claim 22, wherein the pick-up groove includes a plurality of zones, in which the width of the pick-up groove in each zone decreases in a direction opposite to the rotational winding direction.

40. The yarn carrier tube of claim 39, wherein the plurality of zones includes at least one of a gathering zone, a transition zone, and a snagging zone.

41. The yarn carrier tube of claim 40, wherein the plurality of teeth are located within the snagging zone.

42. The yarn carrier tube of claim 39, wherein the plurality of zones includes a third zone, in which the adaptable snagging feature is located.

* * * * *